US006707037B2

(12) United States Patent
Whitehouse

(10) Patent No.: US 6,707,037 B2
(45) Date of Patent: Mar. 16, 2004

(54) ATMOSPHERIC AND VACUUM PRESSURE MALDI ION SOURCE

(75) Inventor: Craig M. Whitehouse, Branford, CT (US)

(73) Assignee: Analytica of Branford, Inc., Branford, CT (US)

( * ) Notice: Subject to any disclaimer, the term of this patent is extended or adjusted under 35 U.S.C. 154(b) by 0 days.

(21) Appl. No.: 10/155,334

(22) Filed: May 24, 2002

(65) Prior Publication Data

US 2002/0175278 A1 Nov. 28, 2002

Related U.S. Application Data

(60) Provisional application No. 60/293,783, filed on May 25, 2001.

(51) Int. Cl.[7] ..... H01J 49/00

(52) U.S. Cl. ..... 250/288; 250/287

(58) Field of Search ..... 250/281, 282, 250/283, 284, 285, 286, 287, 288, 289, 290, 291, 292, 293, 294, 295, 296, 297, 298, 299, 300

(56) References Cited

U.S. PATENT DOCUMENTS 5,663,561 A * 9/1997 Franzen et al. ..... 250/288
6,331,702 B1 * 12/2001 Krutchinsky et al. ..... 250/288
6,348,688 B1 * 2/2002 Vestal ..... 250/288
6,515,280 B1 * 2/2003 Baykut ..... 250/288

* cited by examiner

*Primary Examiner*—John R. Lee
*Assistant Examiner*—James P. Hughes
(74) *Attorney, Agent, or Firm*—Levisohn, Berger & Langsam, LLP

(57) ABSTRACT

A Matrix Assisted Laser Desorption Ionization (MALDI) Source operated at atmospheric or vacuum pressure is interfaced to a multipole ion guide or ion funnel with alternating current (AC or RF) waveforms applied. The multipole ion guides or ion funnels are configured to focus transport, trap and/or separate ions produced from a MALDI ion source and direct the MALDI produced ions to a mass analyzer for MS or MS/MS$^n$ mass to charge analysis. The MALDI sample targets can be positioned at the entrance of a multipole ion guide or ion funnel with gas flow and electric fields configured to direct ions efficiently into the ion guide or ion funnel. Alternatively, the MALDI target can be positioned inside the multipole ion guide or ion funnel so that ions produced are immediately exposed to the RF focusing electric fields inside the ion guide or ion funnel. Ions produced by MALDI operated at atmospheric or intermediate vacuum pressures experience ion to neutral gas collisions as they are transported in the multipole ion guide or ion funnel in the presence of RF electric fields. The gas collisions serve to damp the ion trajectories toward the ion centerline, improving ion transport efficiency into and through vacuum. Ion mobility and mass to charge separation of ions can be performed in the multipole ion guide and ion funnel devices while transporting and focusing ions. When a moving belt is used to interface between Capillary Electrophoresis (CE) or Liquid Chromatography (LC) and a MALDI ion source, the moving belt can be configured to run through a multipole ion guide operated at atmospheric or vacuum pressure regions. Positive and negative ions produced with MALDI ionization can be simultaneously sampled from opposite ends of a multipole ion guide and mass to charge analyzed in parallel.

12 Claims, 28 Drawing Sheets

ATMOSPHERIC AND VACUUM PRESSURE MALDI ION SOURCE

This application claims the benefit of provisional application No. 60/293,783 filed May 25, 2001.

BACKGROUND OF THE INVENTION

Matrix Assisted Laser Desorption Ionization (MALDI) has become an important ionization technique for use in mass spectrometry. MALDI ion sources are typically configured to produce ions in vacuum pressure that is lower than $10^{-4}$ torr. Ions are produced in MALDI ionization by impinging a pulse of laser light onto a target on which a sample solution has been deposited with an appropriate matrix. The resulting ions produced from a MALDI laser pulse are directed into a mass spectrometer where they are mass to charge analyzed. Time-Of-Flight (TOF) mass analyzers are particularly well suited to mass to charge analyze MALDI generated ions. Ions produced from a MALDI pulse in the TOF vacuum region are accelerated into the TOF flight tube and mass analyzed. Techniques such as delayed extraction or reverse acceleration have been employed to improve the resolution when acquiring low vacuum pressure MALDI TOF mass spectra. TOF mass analyzers are capable of separating and detecting ions over a wide mass to charge range, which is essential when analyzing higher molecular weight compounds. MALDI ion sources have also been interfaced to other mass spectrometer types including Fourier Transform Mass Spectrometers (FTMS) and three dimensional quadrupole ion traps (Ion Traps).

Several recipes are available for optimizing a sample and MALDI matrix combination for a given laser wavelength. Typically a nitrogen laser may be used with a DHB matrix. The matrix is chosen to absorb the laser wavelength and transfer the laser power to the matrix to achieve rapid heating of the sample. The rapid heating desorbs and ionizes the sample that was initially dissolved and dried in the matrix solution and a portion of the sample molecules are ionized in the desorption process. To prepare a sample for MALDI ionization, sample solution and matrix solution are combined, deposited on a MALDI probe and dried prior to insertion of the probe into the MALDI ion source. Various conductive and dielectric materials such as glass, metal, silicon and plastics have been configured for use as the MALDI probe substrate. Hydrophobic substrate materials have been used to avoid spreading and thinning of the sample and matrix solution when it is deposited on the probe. It is desirable to concentrate the sample in as small a volume as possible on the MALDI probe to increase the sample ion yield per laser pulse. The MALDI probe substrate should not react with the sample, contribute minimum background peaks in the mass spectrum and allow sufficient binding of sample and matrix to prevent sample loss during MALDI probe handling. When conditioned silicon surfaces are used as MALDI targets, the use of a matrix solution can be eliminated. In some of the embodiments of the invention described below, the additional constraint of using a dielectric MALDI probe material allows the configuration of MALDI probe targets positioned within multipole ion guides or ion funnels causing minimum distortion of Electric fields.

Ions produced from MALDI ion sources configured in the low vacuum pressure region of TOF mass analyzers can be pulsed directly into the TOF MS flight tube for mass analysis. This configuration minimizes any constraint on the mass to charge range that can be analyzed but may limit the resolving power and mass measurement accuracy that can be achieved. Ions that are produced from a MALDI matrix have an uncorrelated energy and spatial spread in the pulsing region of a TOF mass analyzer, resulting in reduced resolving power and mass measurement accuracy in TOF ion mass to charge analysis. Although delayed extraction or reverse field extraction of MALDI produced ions has reduced the effects of ion energy and spatial spread, the techniques have a limit as to how much improvement can be achieved. Also delayed extraction must be carefully tuned to minimize distortion of ion signal intensities in the mass to charge range of interest. The kinetic energy spread of MALDI produced ions also reduces the ion transport and capture efficiency in FTMS and ion trap mass analyzers resulting in decreased sensitivity. Mass to charge selection and fragmentation experiments known as MS/MS experiments may be achieved by using MALDI post source decay or by the configuration of gas collision cells in TOF mass analyzer flight tubes. Ion fragmentation and MS/MS TOF experiments have been achieved using these TOF techniques at some sacrifice to resolving power, mass measurement accuracy and, in some configurations, sensitivity. In an effort to improve mass to charge measurement, resolving power, mass to charge selection precision and efficiency and fragmentation efficiency in MS/MS analysis of MALDI produced samples, MALDI ion sources have been configured in atmospheric pressure and in intermediate vacuum pressure regions of mass analyzers.

Introducing MALDI samples into an atmospheric (AP) or intermediate vacuum pressure (IP) MALDI ion source facilitates sample handling by eliminating the need to load MALDI samples into low vacuum pressure. Laiko et al. in U.S. Pat. No. 5,965,884 and in Anal. Chem. 2000, 72, 652–657 describe the configuration of an atmospheric pressure MALDI Ion source interfaced to an orthogonal pulsing TOF mass analyzer. Krutchincsky et al. J. Am. Soc. Mass Spectrom 2000, 11, 493–504, describe the configuration of MALDI ion source in the second vacuum pumping stage of a hybrid quadrupole/quadrupole/orthogonal pulsing TOF (QTOF) mass analyzer that includes an atmospheric pressure Electrospray ion source. In the atmospheric and vacuum pressure MALDI mass spectrometers described, the ions traverse at least one multipole ion guide prior to being pulsed into the TOF mass analyzer. The mass to charge range of ions that can be analyzed is limited to the range of mass to charge values that can be transmitted with stable ion trajectories through the downstream ion guides. Ion guides positioned in the first or second vacuum pumping stages have pressures maintained sufficiently high to cause multiple ion to neutral background collisions. Elevated background pressures in multipole ion guides cause damping of ion kinetic energies as the ions traverse an ion guide length. The energy damping creates a primary ion beam with a narrow energy spread and a controlled average kinetic energy. Ion mass to charge selection and collisional induced dissociation fragmentation can be achieved in single or multiple ion guide assemblies prior to TOF mass to charge analysis. The upstream ion kinetic energy damping processes result in improved TOF resolving power and ion mass to charge measurement accuracy in orthogonal pulsing TOF. MALDI ionization at atmospheric and intermediate vacuum pressure may yield differences in ion populations when compared with low vacuum pressure MALDI ionization. Neutral to ion collisions occurring in atmospheric pressure and intermediate vacuum pressure MALDI ion source regions reduce the internal energy of the newly formed ion, minimizing post source decay. Subsequent MS/MS functions can be conducted in downstream multipole ion guides, ion traps, FTMS censor TOF-TOF mass analyzers is user controlled through selected experimental methods. The decoupling of the MALDI ionization, ion mass to charge selection, ion fragmentation and subsequent ion mass to charge analysis steps allows independent optimization of each analytical step.

Laiko et al. describe the configuration of a sample MALDI probe positioned near the orifice into vacuum of an API TOF MS instrument so that a portion of the ions produced can be transported into vacuum. A DC field is applied between the MALDI sample target and the orifice into vacuum to direct ions toward the orifice. A gas flow directed over the probe surface was added to push ions produced near the probe surface toward the orifice into vacuum. Laiko reports that substantial sensitivity losses occurred when using the atmospheric pressure MALDI ion source compared with a MALDI ion source configured in the pulsing region of a TOF mass analyzer. Most of the loss of signal was attributed to inefficient ion transport into vacuum. The resulting mass spectrum also included peaks of sample ions clustered with matrix molecules. This clustering may occur due to the condensing of neutral matrix molecules with sample ions in the free jet expansion into vacuum. Krutchinsky et al. describes the configuration of a MALDI probe in the second vacuum stage of a four vacuum stage QTOF where the MALDI target is positioned upstream of the entrance lens orifice to an RF only quadrupole ion guide operating in the second vacuum pumping stage of the QTOF mass analyzer. An additional quadrupole ion guide was added in the second vacuum stage to improve the Electrospray (ES) ion transport efficiency when the MALDI target was removed. Good sensitivities were achieved with MALDI and ES ion sources with the configuration reported. The use of a MALDI ion source operated in vacuum pressure requires that the MALDI target be loaded into vacuum. This constrains the size and shape of the MALDI probe and requires that additional components be added to minimize a decrease in performance of the atmospheric pressure ion sources configured together in the same instrument. Cleaning the vacuum pressure MALDI ion source region requires vacuum venting in the intermediate vacuum pressure stages, causing instrument downtime.

One embodiment of the invention, improves the transport efficiency of ions produced in an atmospheric pressure ion source and reduces or eliminates the number of neutral matrix molecules entering vacuum. The elimination of neutral matrix related molecules from entering vacuum prevents condensation of the matrix molecules with the sample ions in the free jet expansion into vacuum. This eliminates cluster matrix related peaks in the acquired mass spectra. The invention improves the ion transport efficiency into vacuum by reducing the initial atmospheric pressure MALDI (AP MALDI) ion energy spread through ion to neutral collisional damping or focusing of the ion trajectories to the centerline of a multipole ion guide or ion funnel operated at atmospheric pressure with RF voltage applied. AP MALDI generated ions are focused along the centerline and directed to the orifice into vacuum in the ion guides or ion funnels operated at atmospheric pressure. Ions can be trapped and some degree of mass to charge selection achieved using mulipole ion guides at atmospheric pressure. Multipole ion guides have been used to efficiently damp the trajectories of ions and transport ions in intermediate vacuum pressures as have been reported in U.S. Pat. No. 5,652,427 (Whitehouse et al '427), U.S. Pat. No. 6,011,259 (Whitehouse et al. '259) and U.S. Pat. No. 4,963,736 (Douglas et al.). RF only Ion Funnels operated in intermediate vacuum pressure regions of 1 to 2 torr in API MS instruments have been reported by Belov et al., J. Am. Soc. Mass Spectrom 2000, 11, 19–23 and U.S. Pat. No. 6,107,628. Although Douglas et al. achieves effective collisional energy damping in intermediate vacuum pressures they report a severe decrease in ion signal for background pressures above 70 millitorr. Miniature quadrupole mass spectrometers configured for use as vacuum pressure gauges as described by R. J. Ferran and S. Boumsellek, J. Vac. Sci. Technol., A 14(3), May/June 1996 exhibit a decrease in ion signal intensity for pressures which have a mean free path longer than the miniature quadrupole rod dimensions. The reported upper practical operating pressure is the point where the ion to neutral collisional mean free path is roughly equal to the length of the quadrupole ion guide described. Whitehouse et. al. '427 report the operation of a multipole ion guide in background pressures of hundreds of millitorr with little or no loss of ion signal intensity over the entire operating background pressure range. The efficiency of ion transmission through multipole ion guides or ion funnels is maximized by moving ions through the ion guide with axial electric fields and/or directed neutral gas flow. In the present invention, ions are transmitted through a multipole ion guide or ion funnel configured in an atmospheric or vacuum pressure region where multiple collisions occur between ions and neutral background gas molecules during transmission. Ion transmission losses are minimized by providing axial DC voltages and/or gas dynamics to move MALDI generated ions through the entrance RF fringing fields and through the ion guide or ion funnel length. In one embodiment of the invention, atmospheric pressure or vacuum pressure MALDI ions are generated directly in the RF ion trapping field of the multipole ion guides or ion funnels thus avoiding ion scattering losses due to entrance fringing fields entirely.

Ion mobility analyzers have been interfaced with mass spectrometers to allow separation of ions due to differences in ion mobility prior to conducting ion mass to charge analysis. Such a hybrid instrument allows the separation of ions having the same mass to charge value but different collisional cross sections to be analytically separated in mass spectrometric measurements. Coupling ion mobility separation with mass to charge analysis of ions provides additional information regarding the tertiary structure of a molecule or ion. U.S. Pat. No. 5,905,258 (Klemmer) and U.S. Pat. No. 5,936,242 (De La Mora) describe ion mobility analyzers interfaced to mass spectrometers. Klemmer describes a mobility analyzer interfaced to an orthogonal pulsing TOF mass analyzer. De La Mora and Klemmer describe ion mobility analyzers that employ DC electric fields and gas flow to separate ions by their mobility. Unlike the prior art which uses DC only electric fields in a background gas to separate ions due to different ion mobility, the invention enables ion mobility separation from AP MALDI generated ions to occur within a multipole ion guide prior to conducting mass to charge analysis. In the invention, ions are exposed to RF as well as DC electric fields as they traverse the ion guide length. Ion collisions with neutral background gas causes translational energy damping of ion trajectories to the centerline and spatial separation of ions with different ion mobility along the ion guide axis. By radially trapping ions with RF fields and directing the ions in the axial direction with DC fields, the sampling efficiency into the orifice to vacuum after ion mobility separation is improved compared with the ion focusing that can be achieved with DC only electric fields applied in atmospheric pressure as described in the prior.

To facilitate interfacing with higher throughput automated sample preparation and separation systems, the MALDI ion sources must be configured to accommodate a wide range of probe geometries and automated MALDI target sample introduction means. On-line integration of a MALDI ion source with capillary electrophoresis separation systems has been achieved as described by Karger et. al. in U.S. Pat. No. 6,175,112 B1. Sample preparation and separation is being conducted in smaller scale using integrated devices. The current invention is configured to facilitate and optimize the interfacing of an AP MALDI ion source with such integrated sample preparation and sample handing devices and automated MALDI sample target introduction. In one embodiment of the invention, MALDI ionization is conducted from sample deposited on a moving belt positioned to move through a multipole ion guide operated in an atmospheric or vacuum pressure region. The invention allows multiplexed MALDI ionization across parallel sample tracks synchronized with ion pulsing into TOF mass analyzers to increase sample throughput. Improvements in on-line MALDI TOF MS and $MS/MS^n$ performance can be achieved according to the invention by conducting MALDI ionization at atmospheric or vacuum pressures from moving belts traversing laterally through a multipole ion guide from which ions can be subsequently mass to charge selected or fragmented prior to a last mass to charge analysis step.

SUMMARY OF THE INVENTION

In one embodiment of the invention a multipole ion guide with RF and DC electric fields applied to the poles is operated at atmospheric pressure. A MALDI ion source is configured to operate at atmospheric pressure and deliver ions into the multipole ion guide configured to operate at atmospheric pressure. The transfer of AP MALDI ions into and through the multipole ion guide is aided by directed gas flow and DC electric fields. Ion collisions with the background gas damp the stable ion trajectories toward centerline as the ions traverse the length of the multipole ion guide toward an orifice into vacuum. Axial DC electric fields can also be configured to move the ions through the length of the multipole ion guide toward the orifice into vacuum. Ions focused along the centerline are directed with gas flow and DC electric fields into an orifice into vacuum where the ions are mass to charge analyzed or undergo mass to charge selection and fragmentation steps prior to a final mass to charge analysis step ($MS/MS^n$). Gas flow at the ion guide entrance end is directed along the ion guide axis toward the orifice into vacuum to aid in ion transfer into and through the ion guide along the multipole ion guide centerline. In one embodiment of the invention, a second gas flow is introduced at the ion guide exit end directed axially toward the multipole ion guide entrance end, countercurrent to the first gas flow. Ions move in the axial direction against the second gas flow due to the axial DC electric fields. The second gas flow prevents neutral matrix related molecules from entering vacuum with the MALDI produced ions. Reduction or elimination of neutral contamination molecules avoids recondensation of such molecules with sample ions in the free jet expansion into vacuum.

The orifice into vacuum can be configured as a sharp edged orifice, a nozzle, a dielectric capillary or a conductive capillary. The countercurrent gas and/or the capillary tubes may be heated. The face of the orifice into vacuum comprises a conductive material and can be configured as the exit lens of the multipole ion guide operated at atmospheric pressure. The potential of the orifice into vacuum can be increased higher than the multipole ion guide DC offset or bias potential to trap ions in the ion guide. Ions from several MALDI pulses can be accumulated in the multipole ion guide before release into vacuum in this manner. RF, +/−DC and resonant frequency potentials can be applied to the multipole ion guide to reduce the mass to charge range of stable ion trajectories through the ion guide. Using this method, unwanted contamination or matrix related ions can be eliminated before entering vacuum. In non-trapping mode, the multipole ion guide can be operated as a mobility analyzer where ions generated in an Atmospheric Pressure MALDI pulse separate spatially along the ion guide axis due to different ion mobilities as they traverse the multipole ion guide length. In an alternative embodiment of the invention, one or more additional electrostatic lens can be configured between the multipole ion guide exit and the orifice into vacuum. One of these electrostatic lenses can be split to allow steering of selected ions away from the orifice into vacuum. By timing the switching of voltage levels applied to the steering lens elements while conducting ion mobility separation, selected ions can be allowed to enter the orifice into vacuum. Using this technique, different conformations of the same molecule can be isolated and mass to charge analyzed with MS or $MS/MS^n$ experiments to study compound structure.

In an alternative embodiment of the invention, the MALDI probe is configured to place the sample target inside the volume described by the poles of the multipole ion guide operated in atmospheric or vacuum pressure. The MALDI probe and target material may be conductive or dielectric, however, dielectric materials cause minimum distortion of the multipole ion guide RF and DC fields during operation. MALDI ions generated inside the multipole ion guide are trapped in the RF field avoiding the need to transfer ions through RF and DC fringing fields at the ion guide entrance. High capture and transport efficiency can be achieved using this in-multipole ion guide MALDI ion production technique. The MALDI probe can be configured with an array of target samples or be configured as a moving belt to conduct on-line experiments. A moving belt MALDI target can be interfaced on-line or off-line to the outlet of one or more Capillary Electrophoresis (CE) or Liquid Chromatography (LC) columns. The moving belt with the deposited sample and MALDI matrix solution is configured to traverse laterally through the multipole ion guide volume and the sample is ionized near the multipole ion guide centerline as it passes through. The laser beam can be rastered from one sample line to another on the moving belt synchronized with the TOF mass analyzer pulsing to allow multiplexed parallel analysis of several samples with one mass analyzer. This multiple sample analysis technique improves off-line or on-line sample throughput.

In an alternative embodiment of the invention, the MALDI target is configured in an intermediate vacuum pressure region and MALDI produced ions are swept into a multipole ion guide by gas dynamics and applied DC fields. The local gas pressure at the multipole ion guide entrance is maintained higher than the vacuum chamber background gas to aid in sweeping ions into the ion guide entrance minimizing transmission losses due to the ion guide fringing fields. Ions continue to traverse the ion guide length moved by gas dynamics and/or DC fields. Ion to neutral collisions occur as the ions traverse the ion guide length damping the internal and kinetic energies. In one embodiment of the invention the multipole ion guide is configured to extend continuously from one vacuum pumping stage into a subsequent vacuum stage to maximize ion transmission efficiency. The multipole ion guide may be segmented to allow the conducting of ion mass to charge selection and fragmentation analytical functions in the same ion guide volume. This embodiment of the invention improves the ion transfer efficiency of MALDI ions produced in a vacuum pressure region into a mass analyzer. Similar to the atmospheric pressure MALDI ion source embodiment, ion mobility analysis can be conducted on MALDI generated ions in the multipole ion guide configured in an intermediate vacuum pressure region.

MALDI ionization generates positive and negative ions simultaneously. In one embodiment of the invention, a MALDI probe, is configured with the MALDI sample target positioned inside the multipole ion guide. The multipole ion guide may be operated in RF only mode with a DC gradient applied along its axis. The DC gradient is achieved by any number of techniques including but not limited to, configuring the multipole ion guide with segmented, conical or non parallel rods or adding DC electrostatic lens elements external to the multipole rod set which establishes an external axially asymmetric DC field which penetrates to the multipole ion guide centerline. Two mass analyzers are configured to simultaneously accept opposite polarity MALDI generated ions leaving opposite ends of the multipole ion guide. In one embodiment of the invention, the first mass analyzer is operated in positive ion mode and the second analyzer is operated in negative ions mode. Positive MALDI generated ions move along the multipole ion guide axis and exit through one end of the ion guide. The simultaneously produced negative MALDI generated ions move in the opposite direction along the multipole ion guide axis and exit through the opposite end of the ion guide. The positive ions are transferred from the ion guide operated in atmospheric or vacuum pressure and mass to charge analyzed in the first mass to charge analyzer. The negative ions are directed to and mass to charge analyzed in the second mass to charge analyzer.

In an alternative embodiment of the invention, an ion funnel operated with RF and an axial DC fields is configured in place of the multipole ion guide in a MALDI ion source operated in atmospheric or vacuum pressure. The MALDI probe can be configured with the MALDI target positioned inside or outside the ion funnel volume. MALDI produced ions are directed to move axially along the ion funnel using DC fields and directed gas flow. Ion motion in the ion funnel guide is damped due to collisions with background gas resulting in higher ion transport efficiency through the ion funnel exit orifice.

MALDI ion sources operated in atmospheric or vacuum pressure interfaced to multipole ion guides or ion funnels can be configured with but not limited to TOF, TOF-TOF, Ion Trap, Quadrupole, FTMS, hybrid Quadrupole-TOF, magnetic sector, hybrid magnetic sector TOF mass analyzers and other hybrid mass analyzers types.

Other objects, advantages and features of this invention will become more apparent hereinafter.

LIST OF FIGURES

Figure 27:
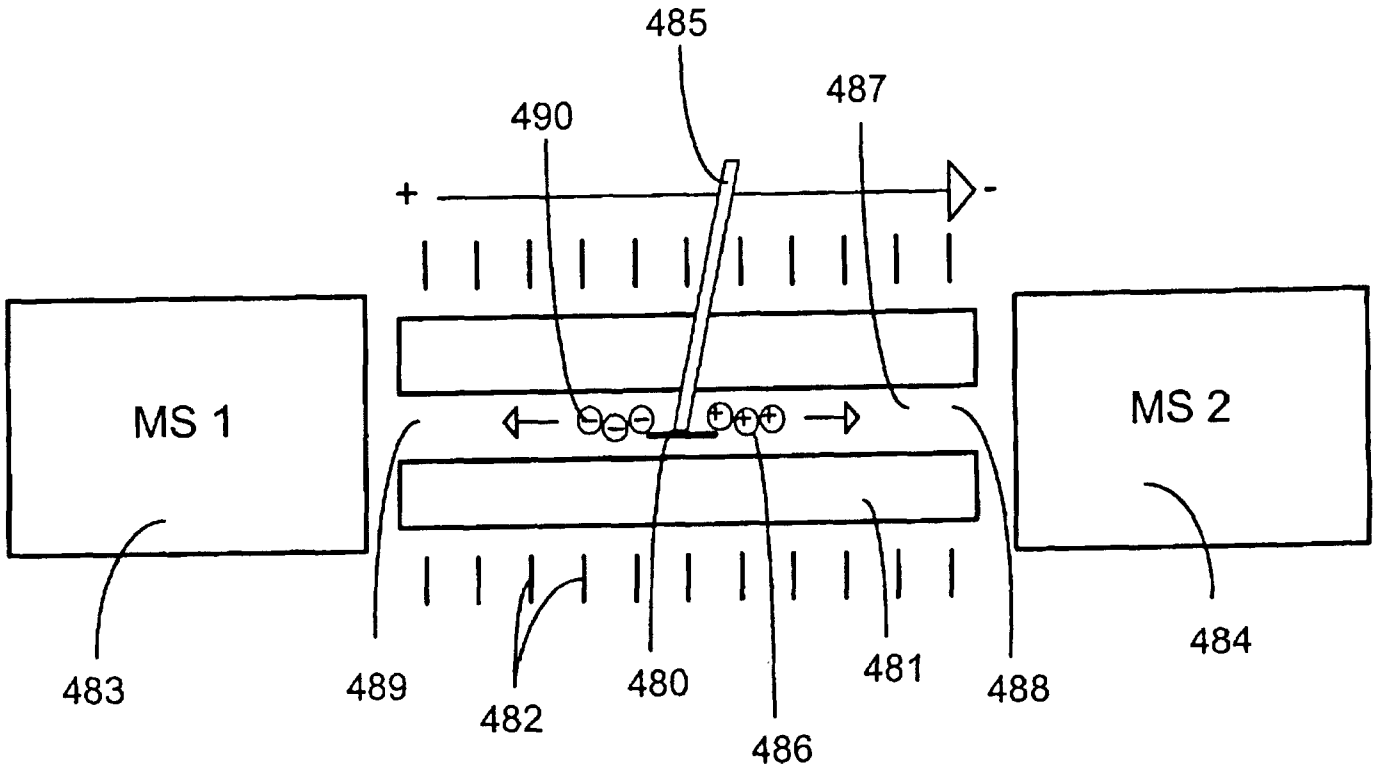

FIG. 27 Shows a MALDI target configured to position a sample spot inside a multipole ion guide operated with an axial electric field. Positive MALDI ions exit one end while simultaneously produced negative ions exit the opposite end of the multipole ion guide. Two mass analyzers are positioned to simultaneously detect positive and negative MALDI generated ions.

Figure 28:
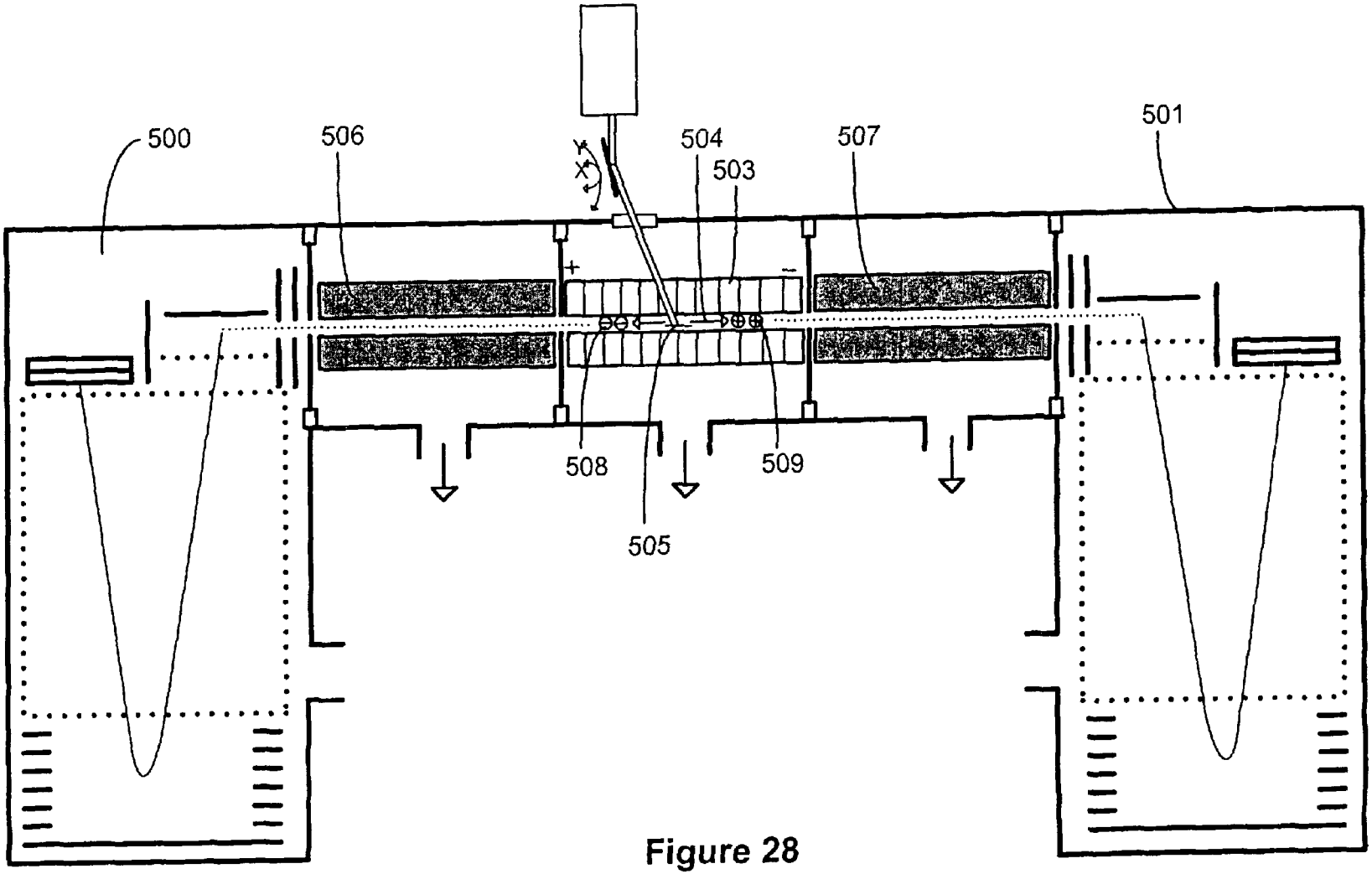

FIG. 28 shows two Time-of-Flight mass analyzers one operated in positive ion mode and one operated in negative ion mode configured to simultaneously mass to charge analyze MALDI ions produced inside the volume of a multipole ion guide.

DETAILED DESCRIPTION OF THE INVENTION

Figure 1:
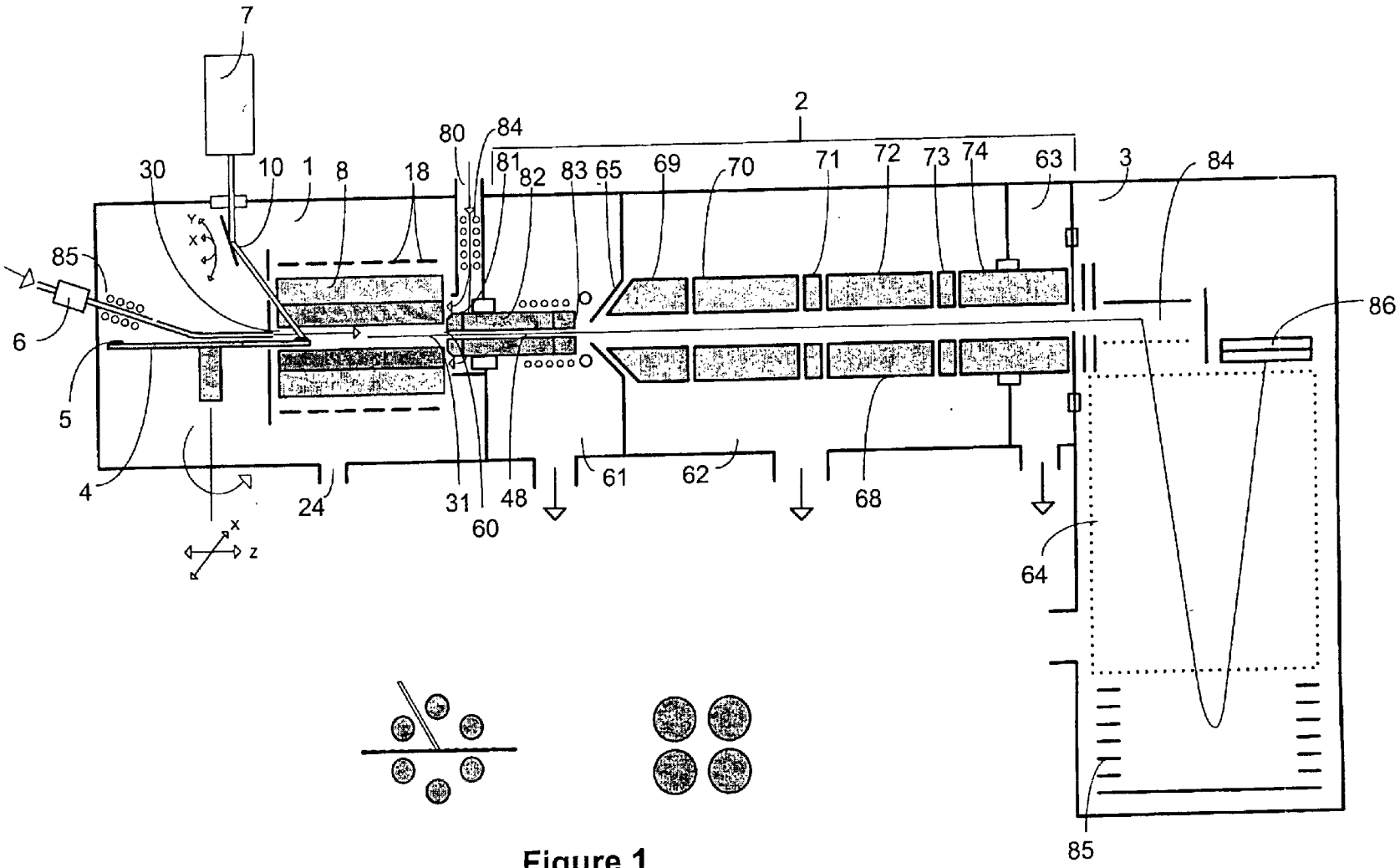
FIG. 1 is one embodiment of the invention where an AP MALDI probe operated at atmospheric pressure is configured to position the MALDI sample target inside a multipole ion guide operated at or near atmospheric pressure.
Figure 2:
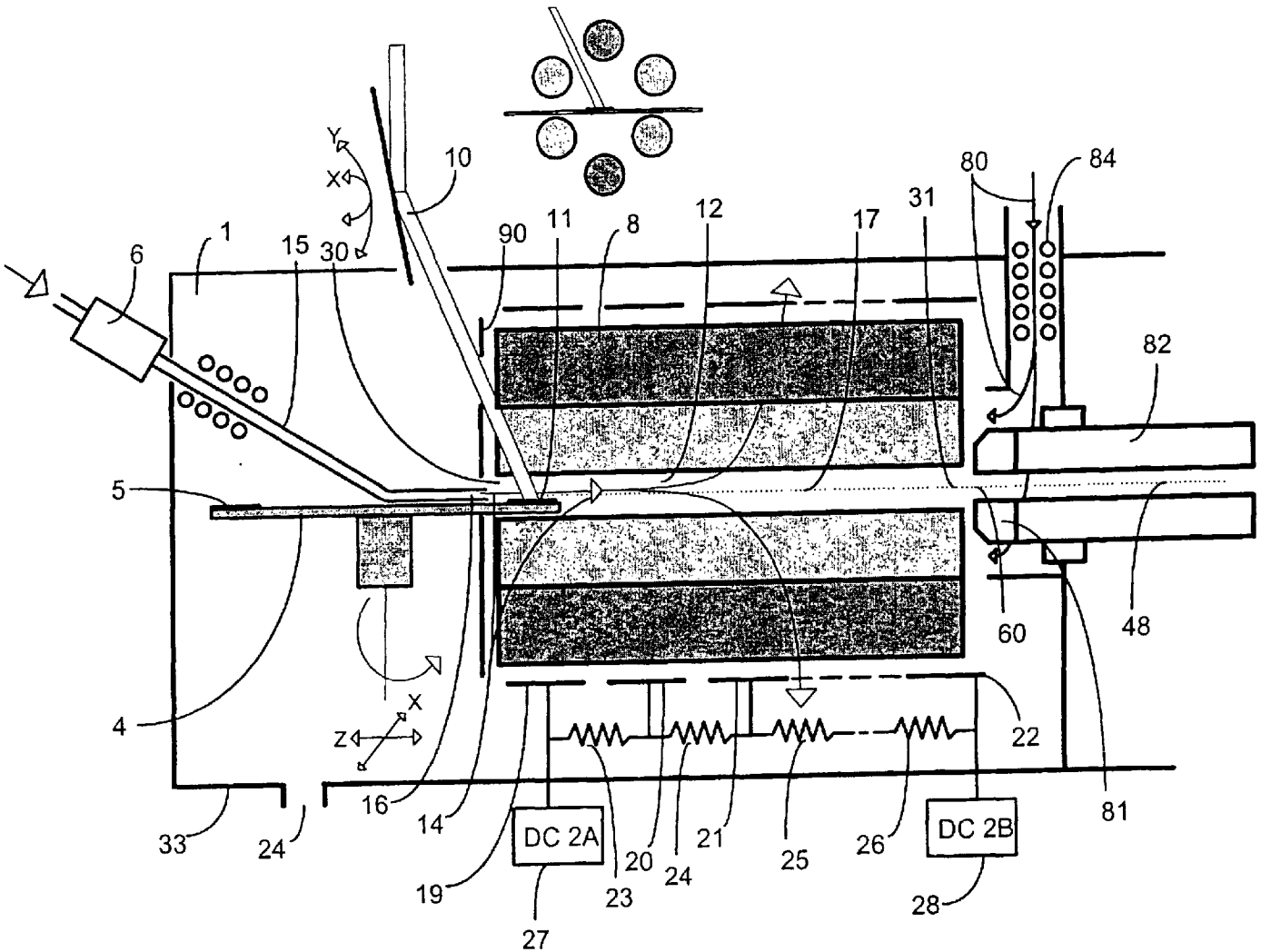
FIG. 2 is a side view of the AP MALDI target region of the embodiment shown in FIG. 1.
Figure 3:
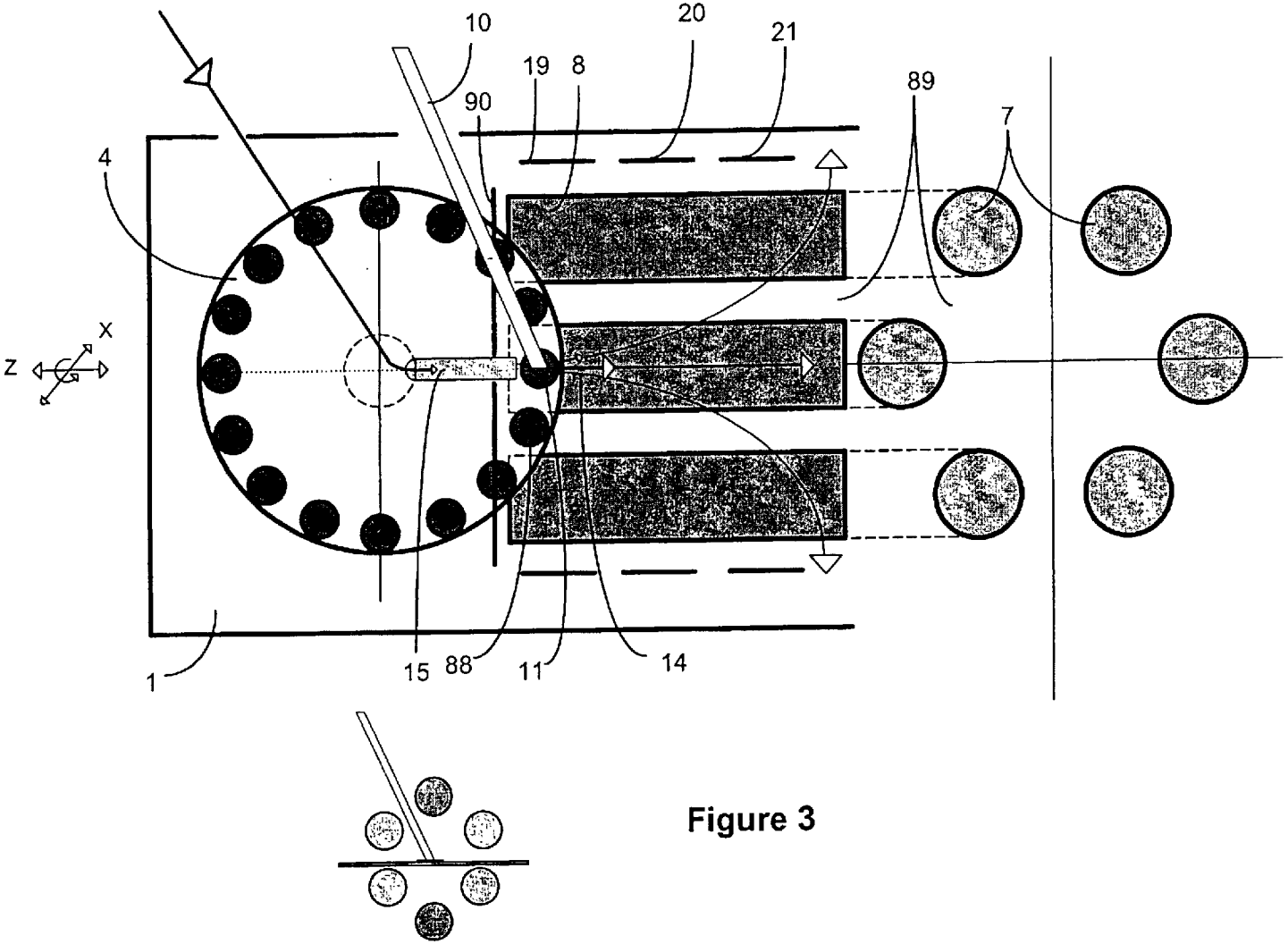
FIG. 3 is a top view of the AP MALDI target region of the embodiment shown in FIG. 1 with a disk shaped MALDI target.

In one embodiment of the invention, ions are produced at atmospheric pressure by impinging a laser pulse on a MALDI target mounted in a multipole ion guide operated in atmospheric pressure. Alternating current (AC or RF radio frequency) and direct current (DC) potentials are applied to the poles of the multipole ion guide to radially trap ions in the multipole ion guide. Collisions between the ions and the atmospheric pressure neutral background gas damp the ion trajectories toward the centerline as the ions traverse the length of the multipole ion guide toward an orifice into vacuum. The ion trajectory in the axial direction is aided by an axially directed gas flow and a DC electric field applied in the axial direction. One preferred embodiment of the invention is diagrammed in FIG. 1. Referring to FIG. 1, atmospheric pressure MALDI ion source 1 is interfaced to Time-Of-Flight mass to charge analyzer 3 through the multiple vacuum stage ion transport region 2. MALDI target 4 with multiple sample spots 5 is configured so that each MALDI sample spot 5 on MALDI target 4 can be positioned near the centerline and inside the poles of multipole ion guide 8. FIG. 2 shows a side view of the MALDI sample target and ion guide entrance region shown in FIG. 1 and FIG. 3 shows a top view of the MALDI sample target configuration of MALDI ion source 1. Laser beam 10 is pulsed onto sample spot 11 deposited on MALDI target 4. In the preferred embodiment, MALDI target 4 comprises a dielectric material including but not limited to glass, silica, ceramic or a polymer material. MALDI target 4 may comprise a hydrophobic material or be coated with a hydrophobic material to minimize the spreading of the sample solution when it is deposited on the probe surface. It is preferred to have smaller and more concentrated MALDI sample spots so that a maximum number of ions from the sample material are produced per laser pulse and a minimum number of laser pulses are required to produced a mass spectrum with sufficient analyte signal to noise.

Laser pulse 10 generated from laser 10 is directed to impinge on sample spot 11 releasing ions and neutral molecules. The MALDI generated ions and neutral molecules collide with the atmospheric pressure background gas present in multipole ion guide 8 internal volume 12. Gas flow 14 is introduced into MALDI ion source 1 through flow control valve 6 and channel 15 whose exit end 16 is oriented to direct gas flow 14 over MALDI sample spot 11 along axis 17 of multipole ion guide 8 in the forward direction. Gas flow 14 may comprise a non-reactive gas such as helium, nitrogen or argon to avoid chemical interaction with MALDI generate sample ions. Alternatively, reactive gaseous components can be used if it is desirable to cause ion molecule reactions. Collisions occurring between neutral gas flow 14 and MALDI generated ions and neutral molecules released from MALDI sample spot 11 serve to damp the ion and MALDI produced molecule trajectories inside multipole ion guide 11. Gas flow 14 moves MALDI generated ions and neutral molecules in the forward axial direction as the applied RF field traps the MALDI generated ions that fall within the operating stability region on the ion guide. The motion of the mass to charge ions that fall within the stability region is damped toward centerline 17 of ion guide 8 by ion collisions with neutral gas molecules. The MALDI generated neutral molecules are free to follow the streamlines of gas flow 14 as it moves through volume 12 of ion guide 8 and out through gaps 89 between poles 7 of ion guide 8.

An axial DC electric field can be applied to aid in moving MALDI generated ions through volume 12 of multipole ion guide 8. One means of achieving an axial DC electric field is to apply decreasing voltages to a set of concentric rings 18 surrounding multipole ion guide assembly 8. As shown in FIG. 2, concentric rings 19 through 22 are connected to resistors 23 through 26 respectively forming a resistive voltage divider between DC electrical power supplies 27 and 28 labeled DC 2A and DC 2B respectively. The DC voltages applied to conductive rings of 19 through 22 penetrate to centerline 17 through gaps 89 of multipole ion guide 8 providing an axial force component to aid in moving ions through ion guide volume 12. For positive ions, power supply 27 is set at a higher positive electrical potential than the potential set on power supply 28 forming a voltage gradient that aids in moving positive ions from entrance end 30 to exit end 31 of multipole ion guide 8. Multipole ion guide 8 may comprise four (quadrupole), six (hexapole) or eight (octopole) rods or poles as the preferred embodiment. Alternatively, multipole ion guide 8 may comprise more than 8 poles or an odd number of poles. The poles may be configured in a parallel arrangment or may be angled to create an axial electric field. The poles may be cylindrical in profile or alternatively tapered to create an axial electric field as is described in U.S. Pat. No. 5,847,386.

A top view of radially symmetric MALDI sample target 4 is shown in FIG. 3. MALDI sample target 4 can be rotated to align a each sample spot with MALDI laser pulse 10 and can be translated in the x an z directions to allow any portion of sample spot to be impinged by laser shot 10 even if the laser beam is focused to a small area at the surface of sample spot 11. Several laser pulses can be taken of sample spot 11 during a TOF mass to charge or MS/MS$^n$ analysis. When the mass analysis of sample spot 11 is complete, MALDI sample target 4 is rotated to move sample spot 88 into the position formally occupied by sample spot 11. MALDI sample target 4, positioned in the gap between poles 7 of ion guide 8 can rotate without touching ion guide 8. Gas flow channel 15 and ion guide entrance entrance lens 90 remain in a fixed position during rotation and x and z movement of MALDI sample target 4. MALDI sample target 4 can be manually or automatically removed and replaced without adjusting the position of gas chennel 15, ion guide entrance lens 90 or ion guide assembly 8.

Figure 4A:
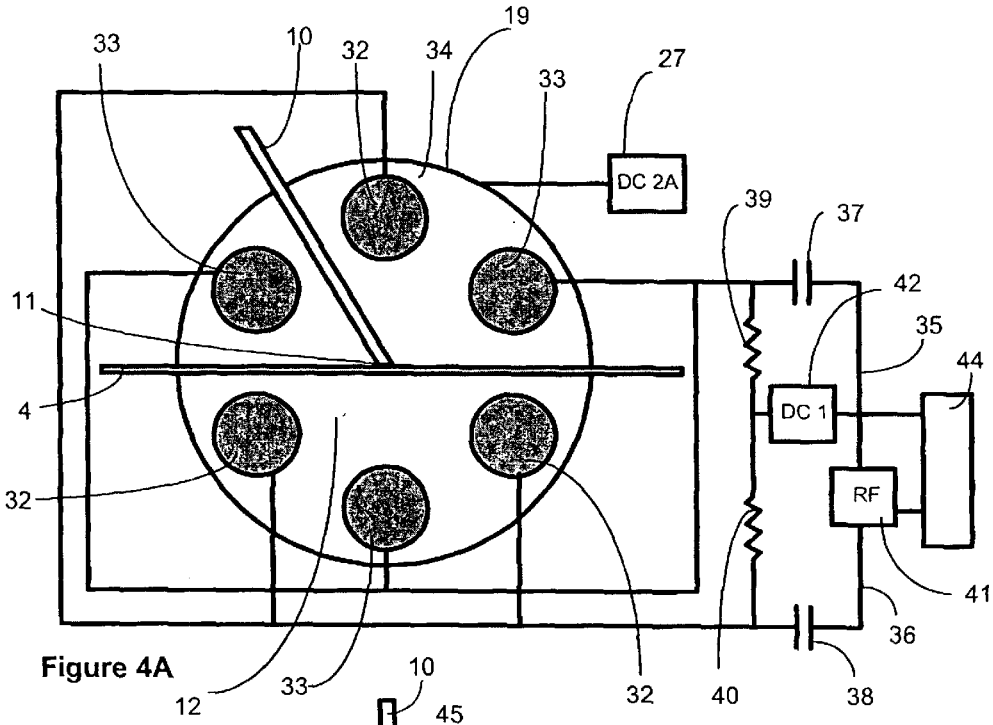
FIG. 4A is a cross section of the hexapole ion guide shown in FIG. 1 configured with one embodiment of the electrical connections to RF and DC power supplies and with the AP MALDI target positioned near the hexapole ion guide centerline.
Figure 4B:
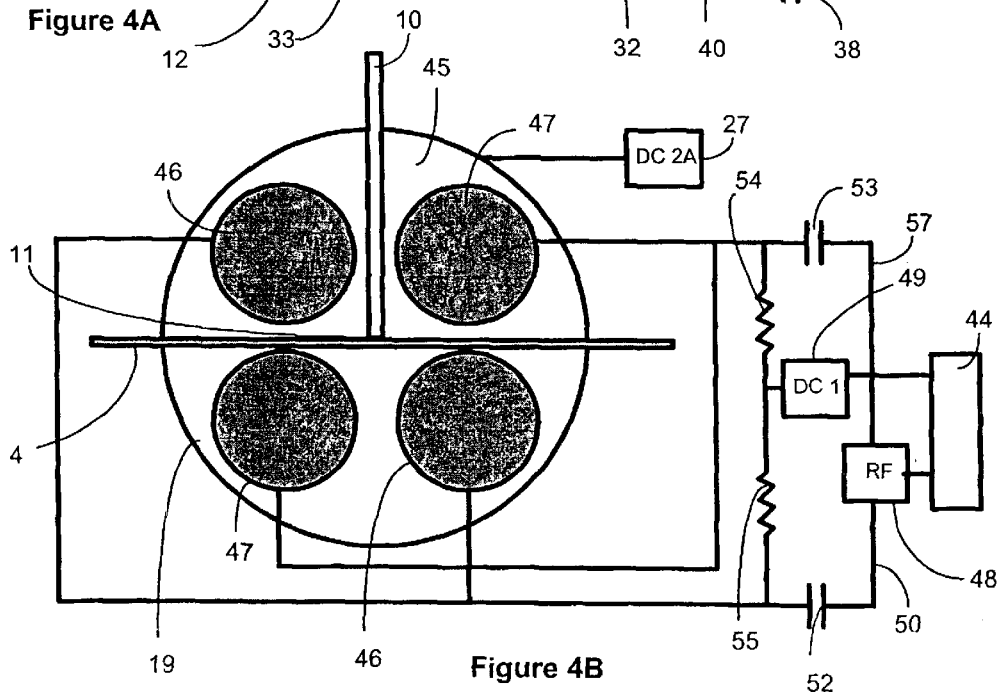
FIG. 4B is a cross section of a quadrupole ion guide configured with one embodiment of the electrical connections to RF and DC power supplies and with a MALDI target located in atmospheric or vacuum pressure positioned near the quadrupole ion guide centerline.

The cross section of two embodiments of multipole ion guide 8 are shown in FIGS. 4A and 4B. The poles have a round cross section shown in FIGS. 4A and 4B but alternatively may have a more ideal hyperbolic cross section. FIG. 4A shows the electrical connection configuration for RF only operation of hexapole ion guide 34. FIG. 4B show the electrical connection configured for RF operation of quadrupole ion guide 40. In FIG. 4A, AC or RF electric fields are applied to poles 32 and 33 of hexapole 34. Three poles 33 of hexapole ion guide 34 are connected to output 35 of RF power supply 41 through capacitor 37 and three poles 32 are connected to output 36 of RF power supply 41 through capacitor 38. The RF electrical potentials applied to outputs 35 and 36 have common amplitude but opposite phase. A common DC offset potential is applied to all poles 32 and 33 of hexapole 24 through DC 1 power supply 42 and resistors 39 and 40 respectively. The outputs of RF power supply 41 and DC 1 supply 42 are decoupled through capaciters 37 and 38 and resistors 39 and 40. The RF potential amplitude and frequency output of RF power supply 41 and the DC potential output of DC 1 power supply 42 may be adjusted manually or through computer control using controller 44. The value of capacitors 37 and 38 and resistors 39 and 40 respectively may be adjusted to balance or tune the potentials applied to poles 32 and 33 of hexapole ion guide 34. An axial DC field can be achieved along the internal length of multipole ion guide by configuring a series of ring electrodes externally along the ion guide length as was described for FIGS. 1 and 2. Ring 19 is connected to DC 2A power supply 27 as the first lens connected to a resistor divider series. As described above, DC field penetration from the ring electrodes creates an axial DC electric field gradient along the length of ion guide volume 12.

In an alternative embodiment for ion guide 8 of FIG. 1, a cross section of quadrupole ion guide 45 is shown in FIG. 4B. RF power supply 48 is connected to poles 46 and 47 through outputs 50 and 51 and capacitors 52 and 53 respectively. An offset DC electrical potential is applied to all poles from DC 1 power supply 49 through resistors 54 and 55 configured for RF only quadrupole ion guide operation. Alternatively, quadrupole 45 can be configured for ion mass to charge range selection by supplying +/−DC to rods 46 and 47 or by adding resonant or secular frequency electrical potentials to the RF electrical potentials applied to poles 46 and 47.

MALDI sample target 4 is configured to extend into internal volume 12 of multipole ion guide 8 as shown in FIGS. 1 through 4. In the preferred embodiment, sample target 4 comprises a dielectric material so that its positioning in multipole ion guide volume 12 causes minimum distortion to the RF and DC electrical fields present in ion guide volume 12. Ions produced from sample spot 11 by laser pulse 10 are immediately subjected to the radial trapping imposed by the RF fields minimizing ion loss. The ions produced by laser pulse 10 will be swept away from the sample spot by gas flow 14 and moved toward ion guide exit end 31. The trajectories of MALDI ions whose m/z values fall within the operating multipole ion guide stability region will be collisionally damped toward ion guide centerline 17 as they traverse the length of multipole ion guide 8. Ions exiting multipole ion guide 8 at exit end 31 near centerline 17 are swept into capillary orifice 60. The relative DC potentials applied to capillary entrance electrode 81 and the ion guide offset potential are set to a value that aids in directing ions into capillary orifice 60. A neutral gas flow 80 is directed countercurrent to gas flow 14 to sweep any neutral MALDI produced contamination molecules away from orifice 60. This prevents recombining or condensing of such MALDI generated neutral molecules with the MALDI generated ions in the free jet expansion as the ions enter vacuum. If desired countercurrent gas flow 80 and gas flow 14 may be heated by heater elements 84 and 85 respectively.

Referring again to FIGS. 1 through 4, ions and neutral molecules produced from impinging laser pulse 10 are swept in the forward direction in volume 12 of multipole ion guide 8 by gas flow 14. The ion forward movement is aided by the presence of the axial DC field created by lens elements 19 through 22, resistor divider 23 through 26 and DC power supplies 27 and 28. Collision damping of ion energy coupled with the RF field cause the ion trajectories to move towards multipole ion guide centerline 17 as the ions traverse the ion guide length in the forward direction. The neutral molecules produced from laser pulse 10 are not confined by the RF fields and move with gas flow 14. A second gas flow 80 is introduced through heater 84 and is directed to flow around capillary 82 and exit as countercurrent a gas flow. Typically gas 80 is a non reactive substance such nitrogen, helium or argon. Countercurrent gas flow 80 is directed in the reverse or backward direction, entering from multipole ion guide exit end 31 and flowing toward entrance end 30. Gas flow 14 encounters the counter current gas flow forming a gas flow stagnation point or gas mixing region in volume 12 of multipole ion guide 8. The opposing gas flows result in both gas flows exiting multipole ion guide 8 through the gaps 89 in the rods or poles 7. The combined gas flows exit source chamber 33 through gas channel 24 as shown in FIG. 2. Ions traversing the length of multipole ion guide 8 are driven through the stagnation point and against the countercurrent gas flow by the axial DC field near centerline 17 and by DC formed by the relative potentials applied between capillary entrance lens 81 and the ion guide 8 DC offset potential. The DC potential applied to capillary entrance electrode 81 is set to direct ions from multipole ion guide 8 into capillary entrance orifice 60. Ions approaching capillary entrance electrode 81 are swept into orifice 60 by the gas flow into and through capillary bore 48. Ions are swept along by the gas flow through capillary bore 48 and expand into vacuum through capillary exit end 83. The potential energy of the ions traversing capillary bore 48 can be changed as described in U.S. Pat. No. 4,542,293 and included herein by reference.

Neutral molecules are swept out of multipole ion guide 8 by forward gas flow 14 and countercurrent gas flow 80 before they reach capillary entrance orifice 60 preventing contamination molecules from entering vacuum with the MALDI generated ions. This avoids condensation of neutral molecules with ions in the free jet expansion region, minimizing any distortion in subsequent ion mass to charge selection and measurement. The heating of countercurrent gas flow 80 serves to aid in the evaporation of any remaining neutral molecules such as solvent or MALDI matrix related molecules condensed on MALDI generated ions as they traverse the length of multipole ion guide 8. Ion movement driven by the axial DC field through countercurrent gas flow 80 may also serve to separate ions along the ion guide length due to differences in ion mobility. Ions produced from a MALDI laser pulse with different ion mobility will arrive at capillary entrance orifice 60 at different times. Switching of the potential applied to capillary entrance electrode 81 can gate ions arriving at different times into or away from capillary entrance orifice 60. As will be described in alternative embodiments of the invention, ions separated spatially by differences in ion mobility can also be electrically gated or steered away from entering capillary entrance orifice 60 by changing the potential applied to additional electrostatic lenses configured between exit end 31 of multipole ion guide 8 and capillary entrance electrode 81. Although some degree of ion mass to charge selection can be achieved with hexapole ion guides, multipole ion guide 8 may be configured as a quadrupole for conducting mass to charge selection at atmospheric pressure with higher resolving power.

Referring to FIG. 1, ions entering orifice 60 of capillary 82 are swept into the first vacuum pumping stage 61 through a supersonic free jet in capillary exit region 83. Ions are focused through the opening of skimmer 65 and move into multiple ion guide assembly 68 comprising rod or pole sections 69 through 74. Ions traversing the length of ion guide assembly 68 move through a background gas with decreasing pressure. Multipole ion guide 74 extends continuously from second vacuum stage 62 into third vacuum stage 63. The neutral gas pressure at the entrance of ion guide assembly 68 may be as high as a few hundred millitorr. The vacuum pressure at the exit end of ion guide assembly 68 may be a low as $10^{-6}$ torr. Ions traversing ion guide assembly 68 whose mass to charge values fall in the multipole ion guide stability regions are captured by the applied RF fields and transported efficiently through several orders of magnitude of background pressure gradient. Multipole ion guide assembly 68 located in vacuum region 2 of FIG. 1 can be operated in a number of trapping and non-trapping modes with combinations of ion mass to charge selection and fragmentation as is described in U.S. patent application Ser. No. 09/235,946. One or more ion mass to charge selection and fragmentation steps followed by product ion mass to charge analysis will be referred to as $MS/MS^n$ mass analysis functions. $MS/MS^n$ mass analysis functions can be performed with one or more steps of ion mass to charge selection and fragmentation conducted in multipole ion guide assembly 68 followed by Time-Of-Flight (TOF) mass to charge analysis. Ions exiting multipole ion guide 74 enter TOF pulsing region 84 and are pulsed into TOF flight tube 64 in a direction substantially orthogonal to the axis of multipole ion guide assembly 68. The ions proceed through the TOF flight tube 64 and ion mirror 85 and are detected on electron multiplier detector 86. Other ion mass to charge analyzer types may be configured replacing the ion guide assembly 68 and TOF mass analyzer shown in FIG. 1. Such ion mass to charge analyzer types may include but are not limited to a quadrupole, three dimensional ion trap, two dimensional ion trap, in line Time-Of-Flight (TOF), TOF-TOF, Fourier Transform (FTMS) or Ion-cyclotron Resonance (ICR) MS, magnetic sector or hybrid mass analyzers.

Figure 5:
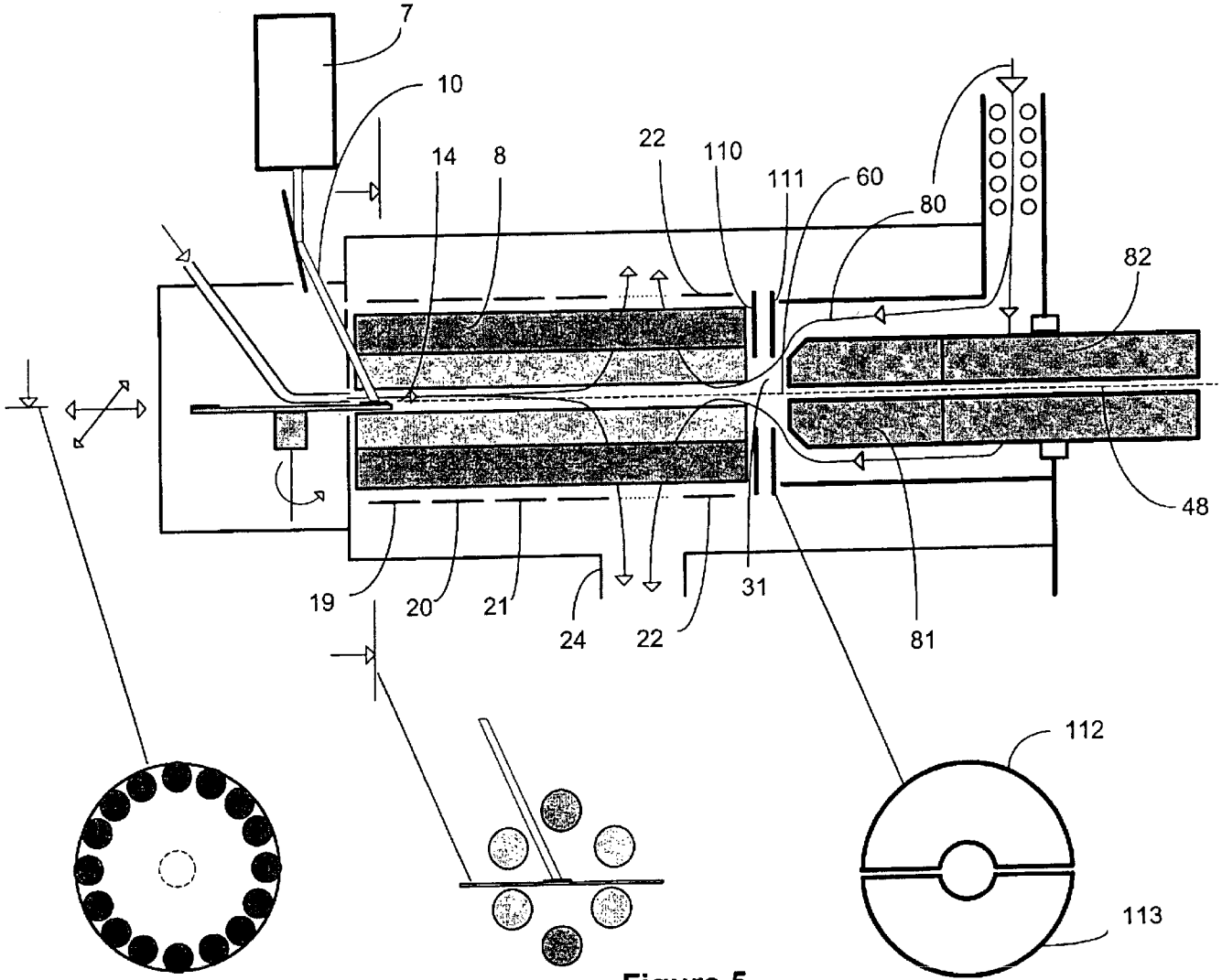
FIG. 5 is the side view of an embodiment of an AP MALDI source configured to conduct ion mobility in the multipole ion guide as ion traverse the ion guide length.

In an alternative embodiment of the invention, shown in FIG. 5, two electrostatic lenses 110 and 111 are positioned between multipole ion guide 8 exit end 31 and capillary 82 entrance orifice 60. Lens 111 is split into halves 112 and 113. As was described previously, MALDI generated ions are directed against countercurrent gas flow 80 by the electric fields applied to lenses 19 through 22. The DC potential applied to electrostatic lenses 110, 111 and capillary entrance lens 81 direct ions from ion guide exit 31 into capillary entrance orifice 60. Ions entering capillary bore 48 are swept into vacuum by the expanding gas flow and subsequently mass to charge analyzed. Different ion species or ions with different folding patterns produced from a MALDI laser pulse will begin to separate due to differences in their mobility as they are driven through countercurrent gas flow 80. Ions of different mobility can be directed to enter capillary entrance orifice 60 or steered away from orifice 60 by adjusting the relative DC voltages applied to lens elements 112 and 113 of electrostatic lens 111. Ions with different ion mobility can be selected or rejected from entering vacuum by pulsing a voltage difference between lens elements 112 and 113. Controlling timing of the differential voltage pulse applied to lens elements 112 and 113 relative to laser pulse 10 allows ions of specific ion mobility to be consistently rejected from or selected to enter capillary entrance orifice 60 for subsequent mass to charge analysis. Lens element 110 prevents the steering voltage electric field to penetrate into entrance region 31 of ion guide 8 minimizing any loss of ions present in this region. The addition of electrostatic lenses 110 and 111 allows more precise control when selecting ions based on their mobility a atmospheric pressure compared with changing the DC potential applied to capillary entrance lens 81.

Figure 6:
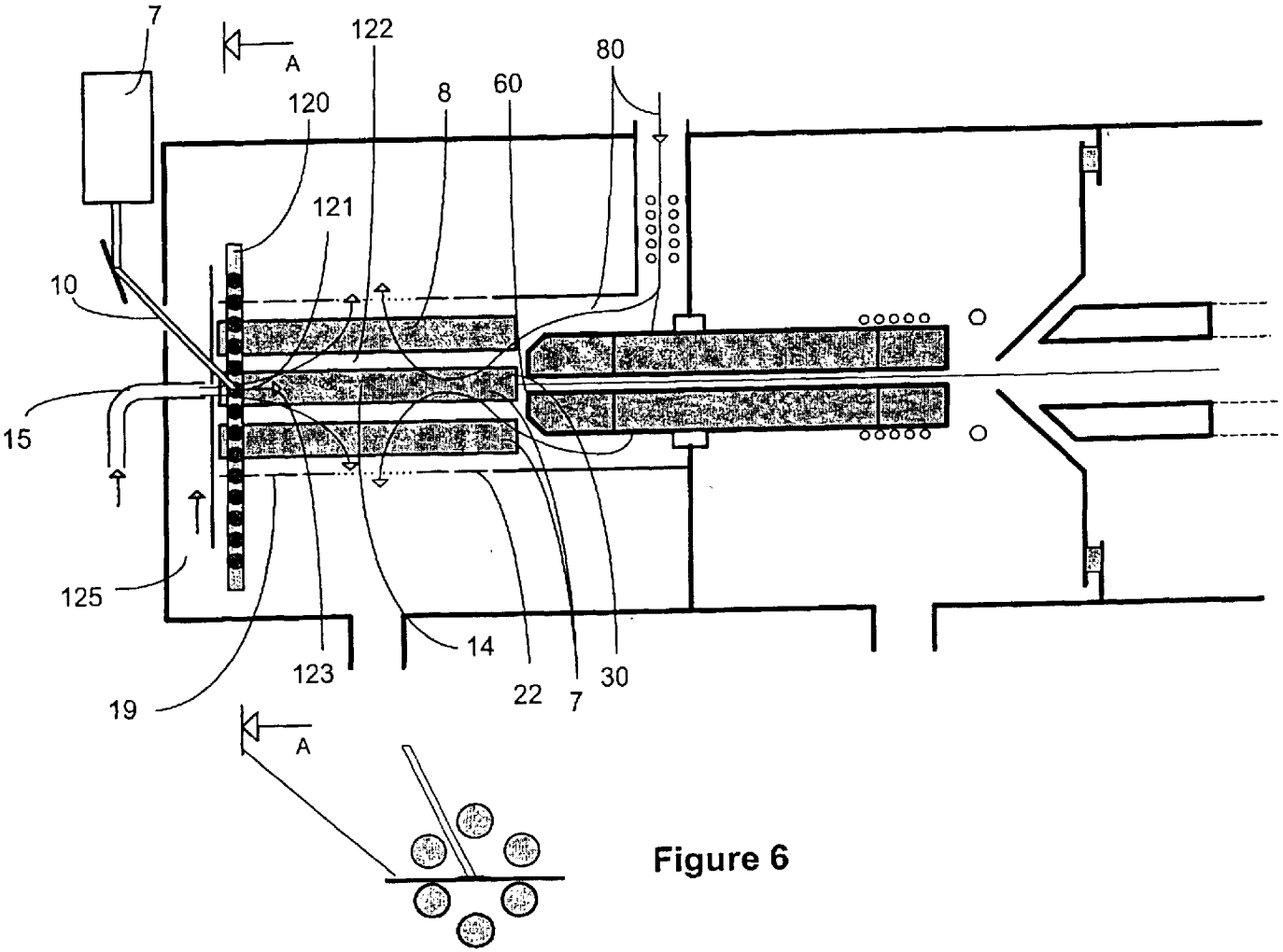
FIG. 6 shows a linear MALDI target with sample spots positioned inside the volume of an ion guide in an AP MALDI ion source.

The invention can be configured with MALDI targets of different shapes, sizes and sample spot patterns. These alternate MALDI target shapes can be configured to position the sample spot inside a multiple ion guide volume. As shown in FIG. 6, a linear MALDI target 120 is positioned in gaps 89 between rods 7 of multipole ion guide 8. Linear shaped sample targets have the advantage of requiring less volume then a round shaped target as shown in FIGS. 1 through 3. Positioning a sample spot on a linear target relative to a laser pulse location is simplified with only x and z axis of movement required. A rotation movement is not needed. Sample spot 121 is located inside ion guide volume 122 where MALDI laser pulse 10 from laser 7 impinges on sample spot 121 to produce MALDI generated ions 123. Gas flow 14 from gas channel 15 move MALDI generated ions 123 toward exit end 31 of ion guide 8. The DC potential applied to ion guide entrance lens 90 relative to the offset potential applied to rods 7 of ion guide 8 and gas flow 14 prevent MALDI generated ions from moving toward the entrance end of ion guide 8. Different sample spots can be selected for analysis by moving MALDI sample target 120 in the x direction. MALDI sample target can be manually or automatically loaded into position in MALDI ion source 125. Each sample spot can be positioned inside ion guide 8 by manual or automated manipulation of a MALDI target position translation assembly.

Figure 7:
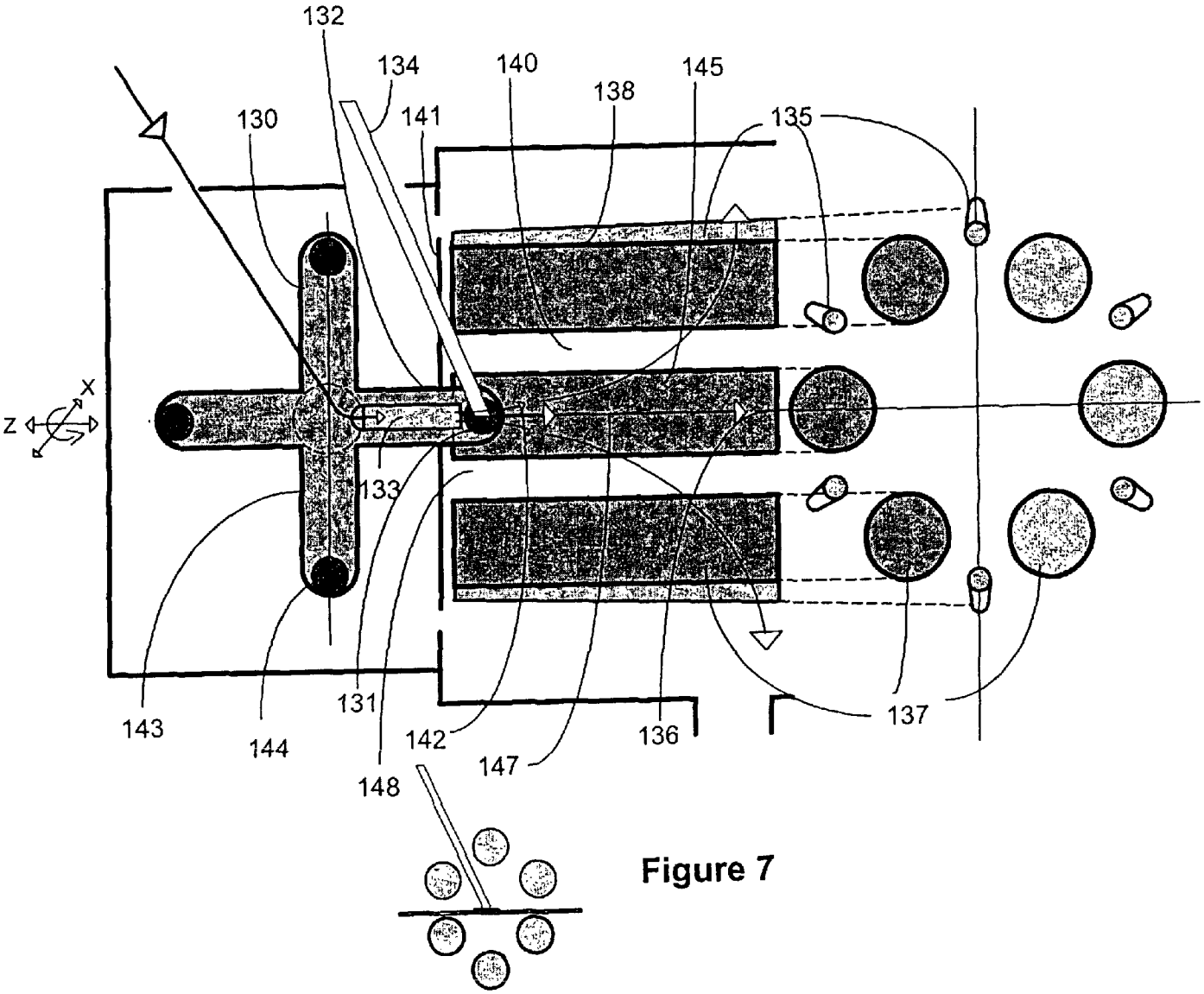
FIG. 7 is the top view of a MALDI target configured with individual sample spot fingers positioned inside the volume of a hexapole ion guide.

An alternative MALDI target 130 shape is shown in FIG. 7 where sample spot 131 is positioned at the end of MALDI target finger 132. Laser pulse 134 is directed through a gap in poles 137 of multipole ion guide 138 to impinge on sample spot 131 positioned within ion guide volume 145. Configuring MALDI target 130 with individual fingers allows the insertion of sample spot 131 without requiring MALDI target 130 to be positioned in the gaps between poles 137 as was shown using the round MALDI target shape diagrammed in FIG. 3. Translating MALDI target 130 in the z direction removes or inserts finger 132 and sample spot 131 into ion guide volume 145 through the entrance end of ion guide 138 while maintaining a distance from ion guide poles 137. A thicker MALDI target geometry can be used if the target is not positioned in the gap of ion guide poles 137. To change sample spots, MALDI target 130 is moved in the negative z direction, away from entrance end 148 of ion guide 138 removing sample spot 131 from ion guide volume 145. MALDI target 130 is then rotated to align finger 143 with ion guide axis 147 and moved in the positive z direction until sample spot 144 is inserted into ion guide entrance end 148 for analysis. MALDI target 130 can be moved in the z and x direction to allow a fixed position laser pulse to impinge on different regions of sample spot 144. Alternatively the position of laser pulse 134 can be directed to different regions on sample spot 144 by moving mirror 106 as shown in FIG. 2. MALDI target 130 may comprise conductive or dielectric material. Less distortion to the RF field in ion guide 138 will occur during operation if MALDI target 130 comprises a dielectric material.

In the embodiment shown in FIG. 7, multipole ion guide 138 is configured as a hexapole. Alternatively, ion guide 138 may be configured as a quadrupole, octapole or with any number of odd or even pole sets comprising at least four poles. MALDI generated ions produced by impinging laser pulse 134 on sample spot 131 are directed along ion guide axis 147 by gas flow 142 exiting from gas channel 133 similar to that shown in FIGS. 1 through 3. MALDI generated ions are radially trapped by the RF field applied to poles 137 of ion guide 138 as previously described. Gas flow 142 and the repelling voltage applied to entrance lens 141 relative to the common DC offset potential applied to poles 137 of ion guide 138 prevents MALDI generated ions from moving toward entrance end 148 of ion guide 138. The MALDI ion source embodiment shown in FIG. 7 comprises angled rods 135 positioned in the gaps between ion guide poles 137. A common DC potential is applied to angled rods 135 forming a DC electric field in the axial direction along the length of ion guide volume 145. This DC field serves to move ions that fall within the operating stability region of ion guide 138 towards exit end 136 of ion guide 138. Similar to the configuration shown in FIGS. 1 through 3, ions exiting ion guide 138 are directed into vacuum through an orifice and subsequently mass to charge analyzed.

Figure 8:
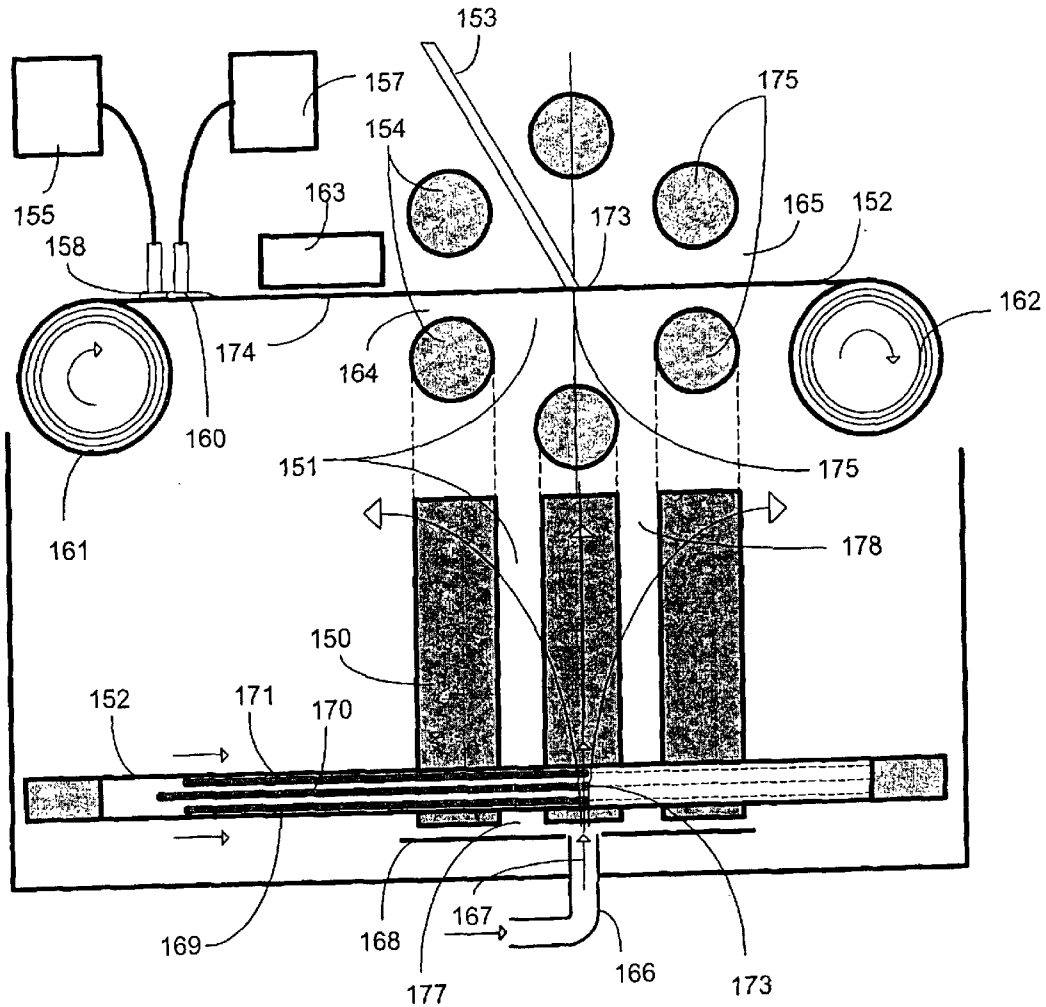
FIG. 8 shows a moving belt MALDI target with sample laid down in lines on the belt surface configured to move through the volume of a multipole ion guide where MALDI sample ionization is conducted.

Alternatively, a moving belt MALDI target can be positioned to extend through the internal volume of an ion guide configured at atmospheric pressure or in a vacuum pressure region. FIG. 8 shows moving belt MALDI target 152 with three sample tracks 169 through 171 deposited from individual capillary electrophoresis (CE) or liquid chromatography (LC) separation systems. The output sample flow 158 from separation system 155 is continuously deposited on moving belt 174. Deposited sample solution 158 is mixed with a MALDI matrix solution 160 delivered from fluid delivery system 157. The sample and MALDI matrix mixture is dried as it passes under heater 163 prior to entering volume 151 of multipole ion guide 150. Controlled rotation of delivery spool 161 and take up spool 162 determines the speed of belt movement. Moving belt 152 passes through gap 164 between ion guide poles 154 and gap 165 between ion guide poles 175. Moving belt 152 may comprise a conductive or dielectric material. Configuring moving belt 152 with a dielectric material, minimizes the distortion of the electric fields within multipole ion guide 150 during operation.

Figure 9:
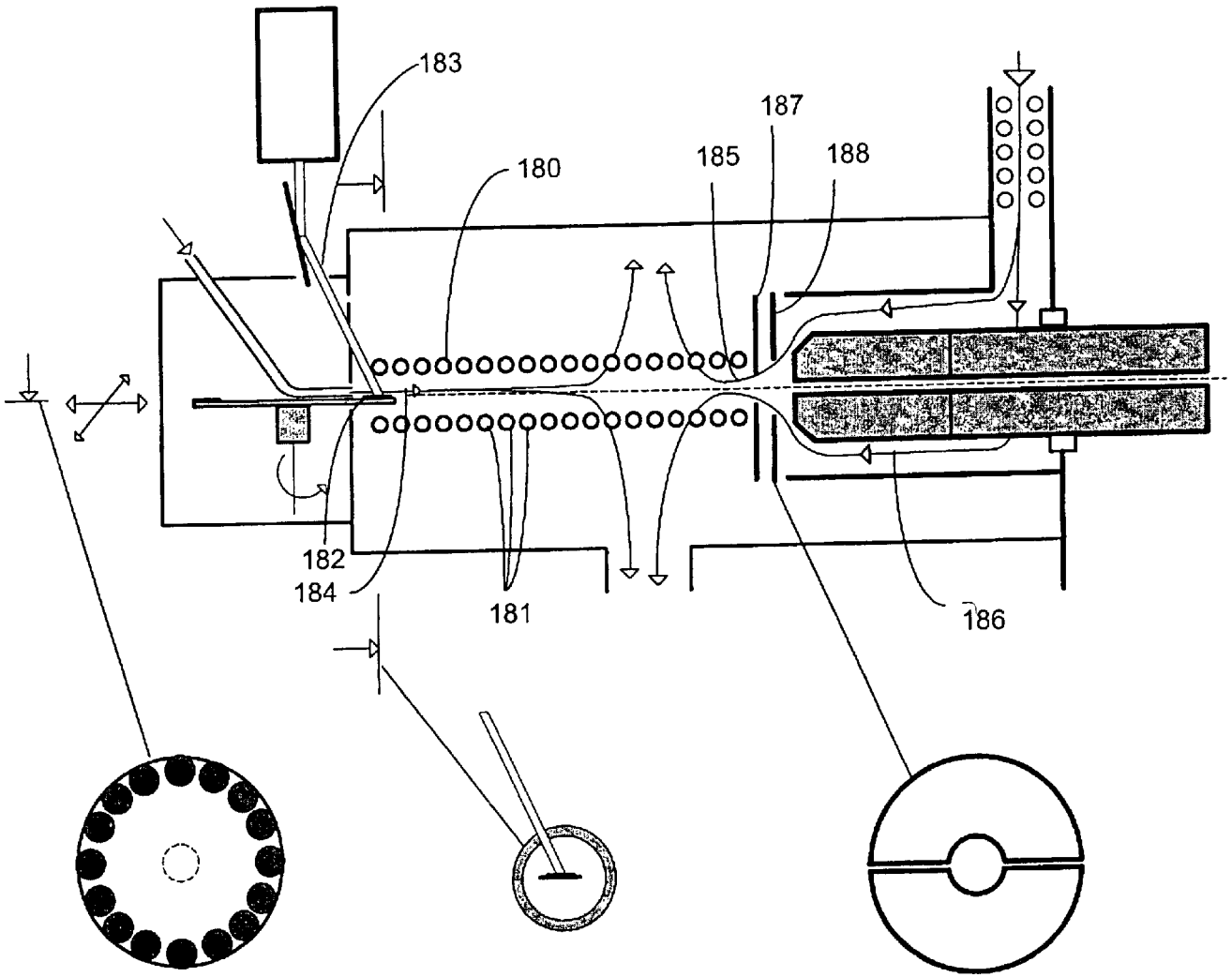
FIG. 9 shows an AP MALDI target positioned to produced ions inside the volume of a consecutive ring RF ion guide assembly operated at atmospheric pressure.

As the dried sample and MALDI matrix track pass through the region of ion guide centerline 175, it is subjected to one or more laser pulses 153. Laser pulse 153 impinging on sample track 170 at location 173 produces MALDI generated ions inside multipole ion guide 150 internal volume 151. Gas flow 167 passes over sample track location 173 sweeping MALDI generated ions away from ion guide entrance 177. Maintaining a potential difference between entrance lens 168 and the common DC offset potential applied to the rods of multipole ion guide 150 during operation prevents MALDI generated ions of the desired polarity from moving in the direction of ion guide entrance 177. MALDI generated ions of a selected polarity that fall within the stability region of ion guide 150 operation are directed to traverse the length of ion guide 150 toward exit end 178 moved by gas flow and DC electric fields penetrating into ion guide volume 151 as was previously described. The MALDI generated ions are directed toward and through an orifice into vacuum where they are subsequently mass to charge analyzed. Ions can be generated from multiple sample tracks 169 through 171 by shifting laser beam 153 to impinge on each track in a controlled manner. Ions generated from different sample tracks can be separately mass analyzed sequentially in time by synchronizing the laser pulse and position timing with the subsequent mass to charge analysis spectrum acquisition. Running multiple sample tracks can increase sample throughput by allowing parallel sample separation systems to operate simultaneously. MALDI generated ion populations from different tracks can be trapped in ion guide 150 to delay their entrance into vacuum or can be trapped in ion guides located in vacuum prior to TOF mass analysis in a hybrid quadrupole TOF mass analyzer as diagrammed in Figure In alternative embodiments of the invention, atmospheric pressure MALDI ion sources may comprise different type of ion guides to trap and direct MALDI generated ions into an orifice into vacuum. One such alternative ion guide is shown in FIG. 9 where a multiple ring ion guide 180 replaces multipole ion guide 8 of FIGS. 1 through 5. As is known in the art, RF voltage is applied to ring electrodes 180 with opposite phase RF applied to adjacent ring electrodes. Each ring electrode 181 has a different DC potential applied forming a DC field in the axial direction along the length of ion guide 180. MALDI generated ions produced by impinging laser pulse 183 on sample spot 182 are swept toward ion guide exit end by gas flow 184. Ions are driven against countercurrent gas flow 186 by the axial DC field applied to ring electrodes 181 of ion guide 180. As was previously described, the potentials applied to electrode 187 and split electrode 188 can be controlled to select ions for mass analysis that are separated while traversing the length of ion guide 180 due to differences in ion mobility.

Figure 10:
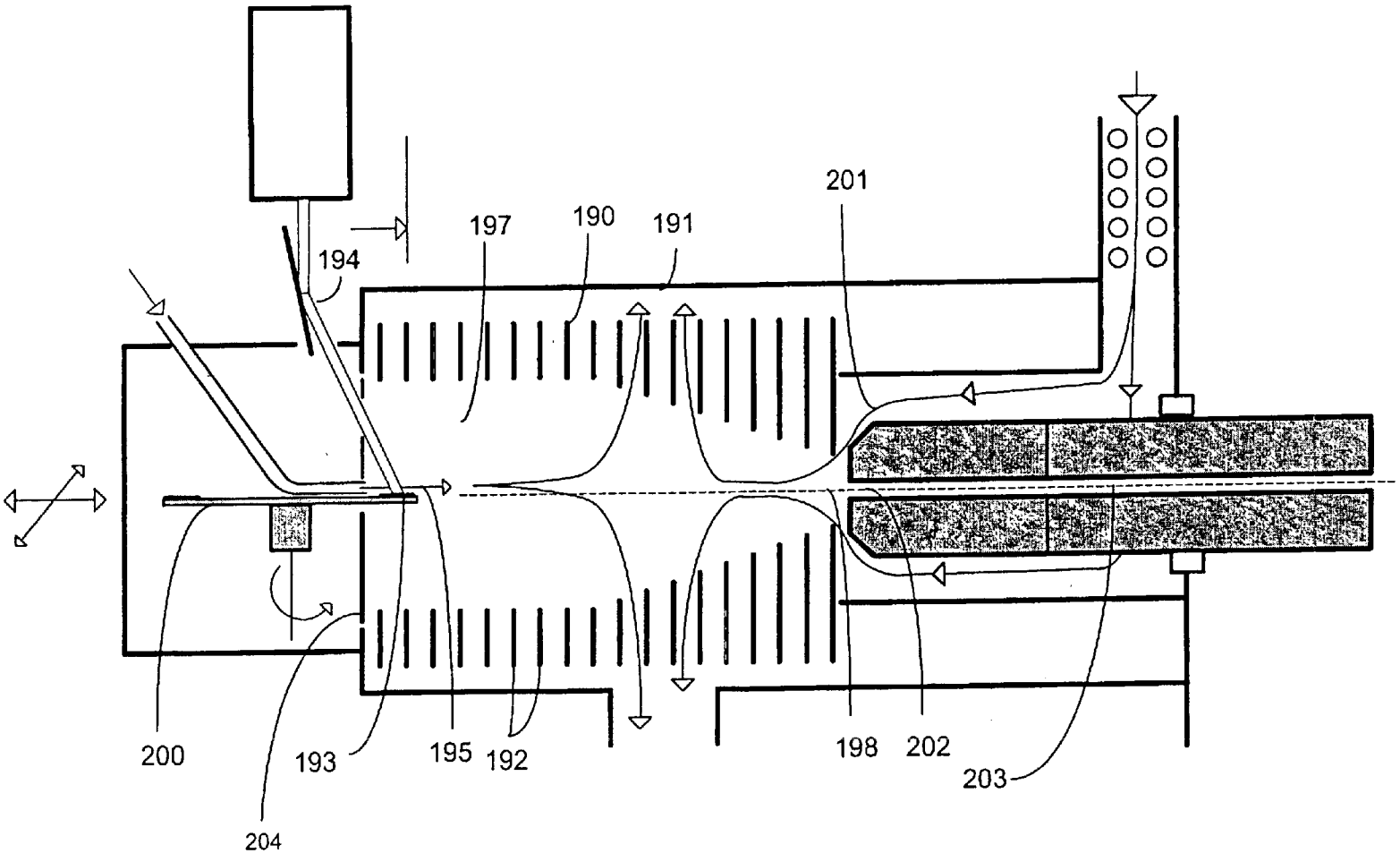
FIG. 10 shows a disk shaped AP MALDI target configured with a MALDI target sample spot inside an ion funnel operated at atmospheric pressure.

Alternatively, as shown in FIG. 10, ion funnel 190 can be configured in place of multipole ion guide 8 in atmospheric pressure MALDI ion source 191. Operation of an ion funnel, as known in the art, is similar to that of a ring electrode ion guide. RF potential is applied to electrodes 192 with opposite phase RF applied to adjacent electrodes. The aperture size in each ion funnel electrode 192 can vary in size along the length of ion funnel 190. Ions are generated inside ion funnel volume 197 by impinging laser pulse 194 onto sample spot 193. MALDI generated ions are swept away from MALDI sample target 200 by gas flow 195 and a DC electric field maintained along the length of ion funnel 190. the DC field is formed by applying different DC voltages to entrance electrode 204 and each electrode 192 along the length of ion funnel 190. The DC field directs ions against countercurrent gas flow 201 and into capillary entrance orifice 202. The MALDI generated ions are swept into vacuum by the gas expanding through capillary bore 103 where the MALDI generated ions are subsequently mass to charge analyzed.

Figure 11:
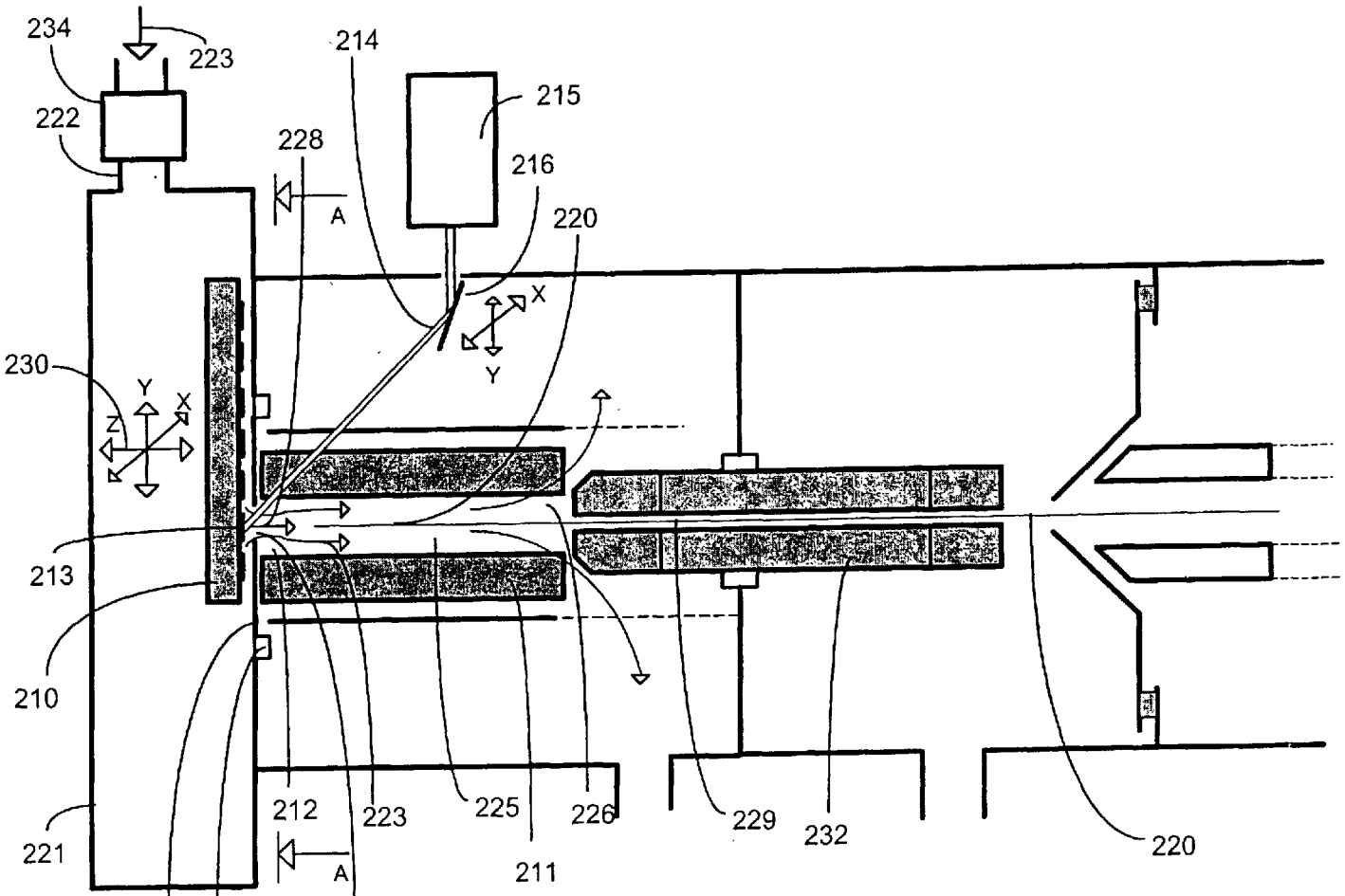
FIG. 11 shows an AP MALDI target mounted outside a multipole ion guide with gas flow directed around the MALDI spot to sweep ions into said multipole ion guide operated at atmospheric pressure.
Figure 12B:
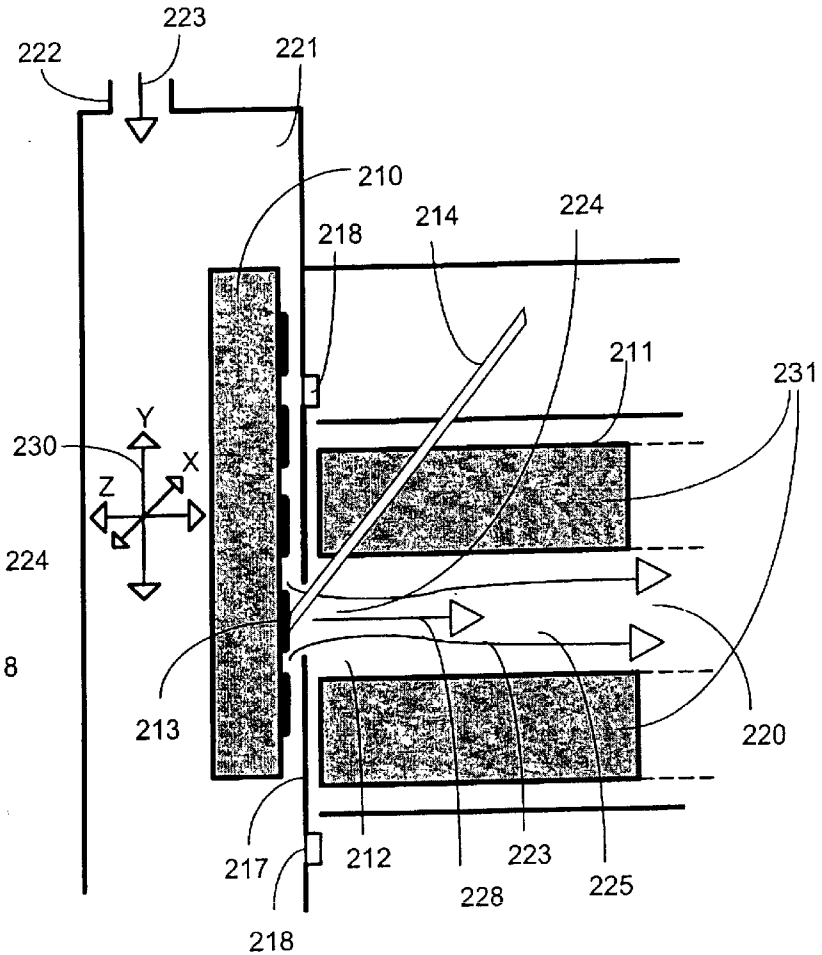
FIG. 12B shows a face view of the MALDI target sample spot positioned at the Multipole ion guide entrance region as configured in FIG. 11.

If the MALDI target is not positioned within a multipole ion guide or ion funnel, the constraints imposed by the ion guide geometry or electric fields on the MALDI target materials and shape are eliminated. Any loss in ion capture or transport efficiency may be compensated by increased flexibility in MALDI sample target configuration and manipulation. An alternative embodiment of the invention is shown in FIGS. 11 and 12 where MALDI sample target 210 is positioned at entrance end 212 of multipole ion guide 211. MALDI sample target 210 is configured to align sample spot 213 with entrance end 212 of ion guide 211 such that the sample spot surface is facing ion guide centerline 220. MALDI sample target 210, mounted on X-Y-Z translation stage 230 is located in chamber 221. Gas flow 223 enters chamber 221 through flow control valve 234 and gas flow channel 222 and exits through aperture 224 in ion guide entrance lens 217. Exiting gas flow 223 sweeps MALDI generated ions 228 formed from sample spot 213 into multipole ion guide volume 225. In the embodiment shown in FIG. 11, gas flow 223 pushes MALDI generated ions 228 through the length of ion guide 211 while the RF field applied to rods 231 of ion guide 211 trap ions in the radial direction whose mass to charge values fall within the ion guide operating stability region. Due to collisions with neutral gas molecules, the trajectories of MALDI generated ions damp to center of ion guide volume 225 as they traverse the length of ion guide 211. MALDI generated ions 228 traversing the length of multipole ion guide 211 to ion guide exit end 226 enter capillary bore 229 where they are swept into vacuum through capillary 232 and subsequently mass to charge analyzed.

Figure 12A:
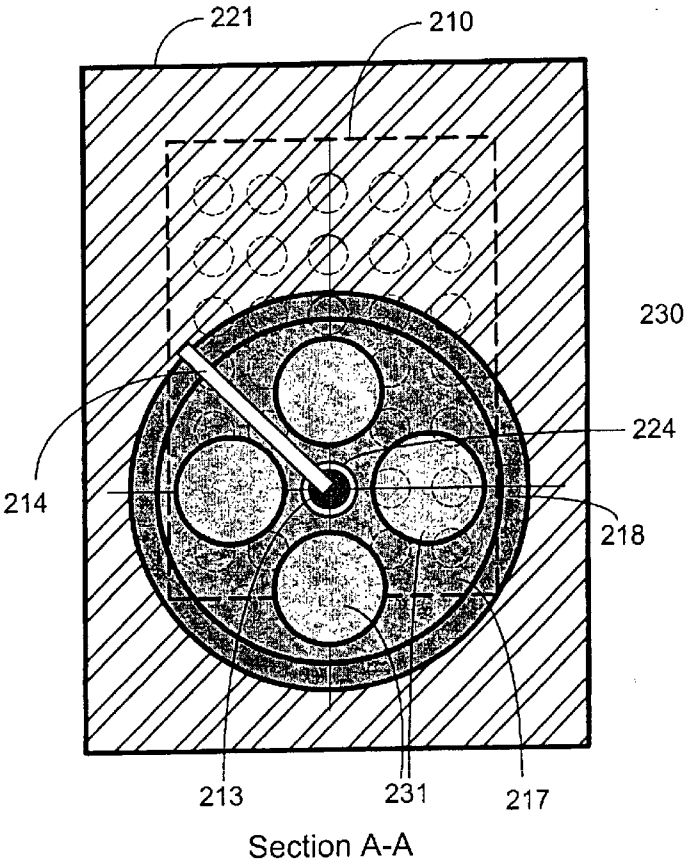
FIG. 12A shows cross section A—A of FIG. 11.

The gap between multipole ion guide entrance electrode 217 and MALDI target 210 may be adjusted to optimize performance using the Z translation direction of MALDI target X-Y-Z translator 230. A smaller gap allows a higher gas velocity near the surface of sample spot 213, to sweep ions away from sample spot 213 for a given rate of gas flow 223. If increased gas flow 223 is desired to more effectively sweep the volume of ion guide 211, the gap between entrance lens 217 and MALDI target 210 can be increased to optimize the gas velocity passing over sample spot 213. The flow rate of gas flow 223 is changed by adjusting the setting of gas flow valve 234. When MALDI sample target 210 comprises a conductive material, a DC potential difference can be applied between MALDI sample target 210 and ion guide entrance electrode 217. MALDI generated ions 228 of the desired polarity can be directed into volume 225 of multipole ion guide 211 by gas flow 223 and the electric field applied between MALDI sample target 210 and ion guide entrance lens 217. Closed chamber 221 is electrically isolated from ion guide entrance lens 217 through insulators 218. If MALDI target 210 comprises a dielectric material, it can be backed by a conductive element to establish an electric field at sample spot 213. Section A—A of FIG. 12A shows a face-on view of sample spot 213, lens aperture 224, entrance lens 217 and insulator 218. Different sample spots on MALDI sample target 210 can be aligned with aperture 224 in ion guide entrance lens 217 by moving MALDI sample target 210 in the x and/or y direction. Laser pulse 214 delivered from laser 215 can be directed to hit a specific location on sample spot 213 by moving MALDI sample target 210 or by moving mirror 216 manually or using computer control. MALDI sample target 210 can be automatically or manually loaded into chamber 221 and moved manually or automatically through computer control. MALDI target 210 can be configured with a standard plate dimension and with standard sample spot locations or be configured with a custom shape and custom sample spot locations.

Figure 13:
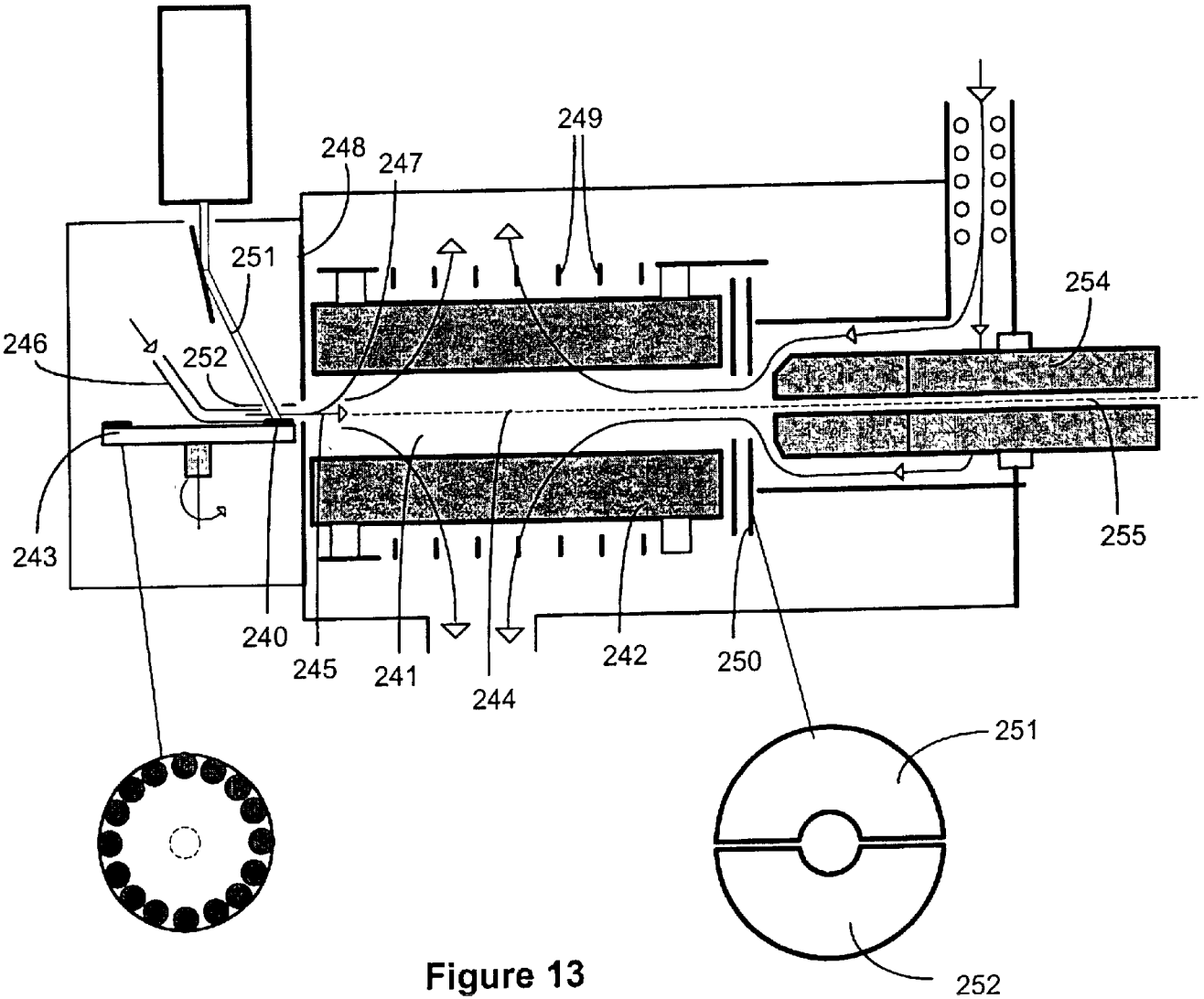
FIG. 13 shows an AP MALDI source configured with the MALDI target surface positioned external to but parallel with the multipole ion guide centerline.

FIG. 13 shows an alternative embodiment of the invention where MALDI generated ions are formed from sample spot 240 positioned outside ion guide volume 241. In the embodiment shown in FIG. 13, MALDI target 243 is configured to position sample spot 240 near multipole ion guide centerline 244. Gas flow 245 from gas channel 246 sweeps MALDI generated ions through ion guide entrance lens aperture 247 in ion guide entrance lens 248 into ion guide volume 241 of multipole ion guide 242. Ions of the desired polarity, generated when laser pulse 251 impinges on sample spot 240, are directed through ion guide entrance lens aperture 247 by gas flow 245 and the appropriate electrical potentials applied to lens 252, MALDI target 243, electrostatic entrance lens 248 and the DC offset potential applied to the poles of ion guide 242. MALDI generated ions are directed through the length of ion guide 242 by applying different DC potentials along ring electrodes 249. The DC potential gradient formed along ring electrodes 249 penetrates into volume 241 of ion guide 242 as was previously described. Selection of ion species based on their mobility can be conducted by applying the appropriate steering potentials across lens half sections 251 and 252 of lens 250. Selected ions are directed into capillary entrance orifice 253 where gas flow sweeps the MALDI generated ions through bore 255 of capillary 254 and into vacuum where they are subsequently mass to charge analyzed. MALDI target 243 is shown circular in shape with sample spots along the outer diameter, however, for the embodiment shown in FIG. 13, MALDI target 243 can be configured in a variety of shapes and with a variety of sample spot patterns.

Figure 14:
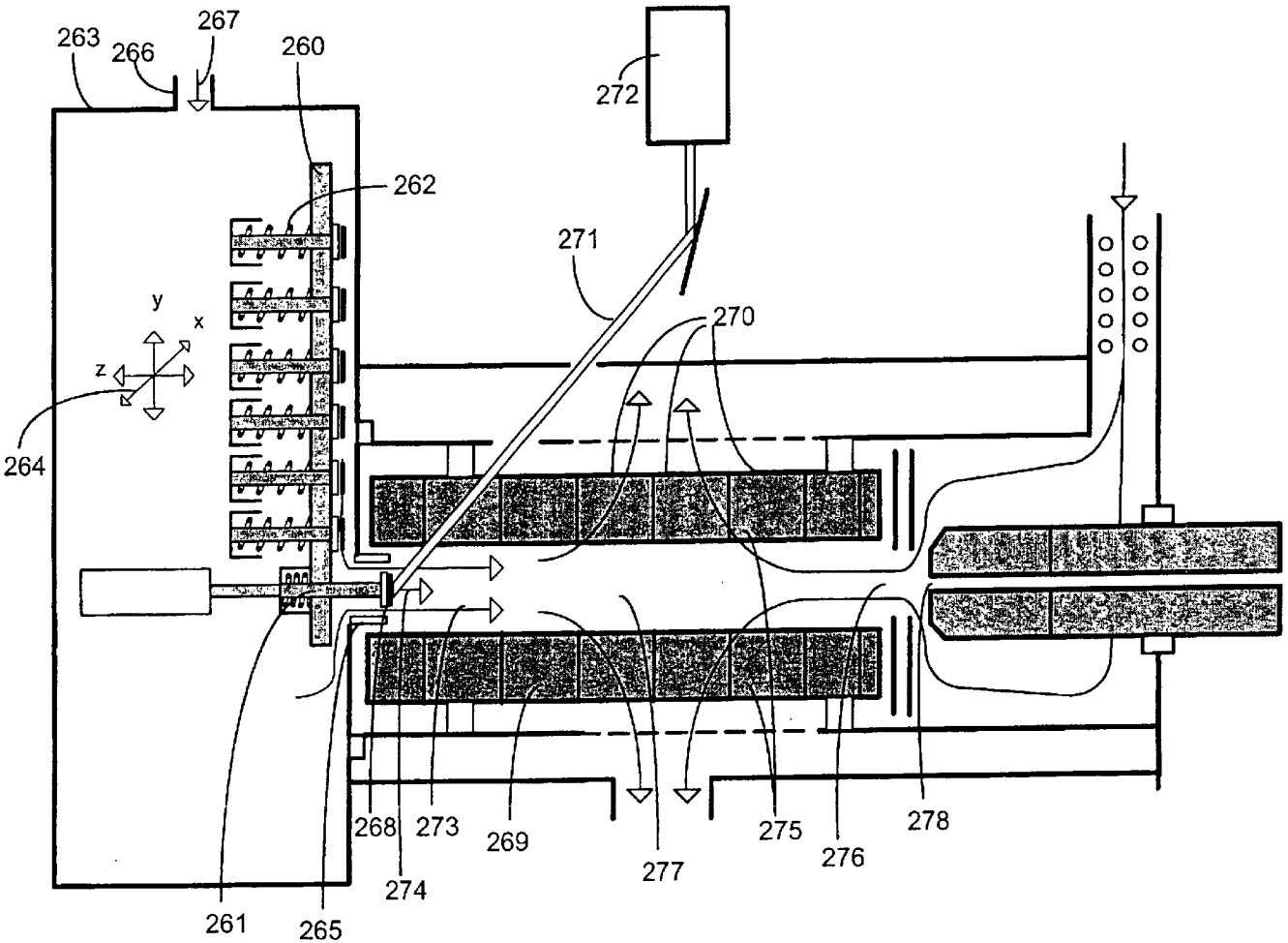
FIG. 14 shows an embodiment of a MALDI target that is configured with individually movable MALDI sample spots.

FIG. 14 shows an alternative embodiment for a MALDI target that allows MALDI generated ions to be formed inside or outside of the volume of a multipole ion guide at atmospheric pressure or in vacuum. MALDI target 260 comprises individual sample spot holders 261 and 262 that can be retracted as shown with sample spot holder 262 or moved forward as shown with sample spot holder 261. Similar to the embodiment shown in FIGS. 11 and 12, MALDI target 260 is configured in chamber 263 and is moved by X-Y-Z translator 264 to line up a sample spot with chamber opening channel 265. Adjustable gas flow 267 enters chamber 263 through gas flow channel 266 and exits through opening channel 265 sweeping around sample spot 268. Laser pulse 271 delivered from laser 272 impinges on sample spot 268 generating ions that are swept into segmented multipole ion guide 269 by gas flow 273. Sample spot holder 261 and opening channel 265 may comprise dielectric or conductive materials. Dielectric materials allow MALDI generated ions to be created directly in the relatively unperturbed RF field of ion guide 269 providing radial trapping of ions during collisional damping of initial ion translational energies. When conductive materials are used for sample spot holder 261 and opening channel 265, MALDI generated ions can be directed away from sample spot 268 toward exit end 276 of ion guide 269 by applying the appropriate electrical potentials to sample spot holder 261, opening channel 265 and segmented rods 275 of ion guide 269. In the embodiment shown, multipole ion guide 269 comprises segment rods where a different DC potential can be applied to each segment 270 to create an axial DC field along the length of ion guide 269. The axial DC field directs ions through ion guide volume 277 toward capillary entrance orifice 278 where they are swept into vacuum for mass to charge analysis. MALDI target 260 with moveable individual sample spots allows the optimal placement of a sample spot relative to the entrance or internal volume of multipole ion guide 269 to maximize MALDI generated ion transfer efficiency into vacuum. Ion mass to charge selection and ion mobility selection can be conducted in the MALDI ion source embodiment shown in FIG. 14 as has been previously described.

Figure 15:
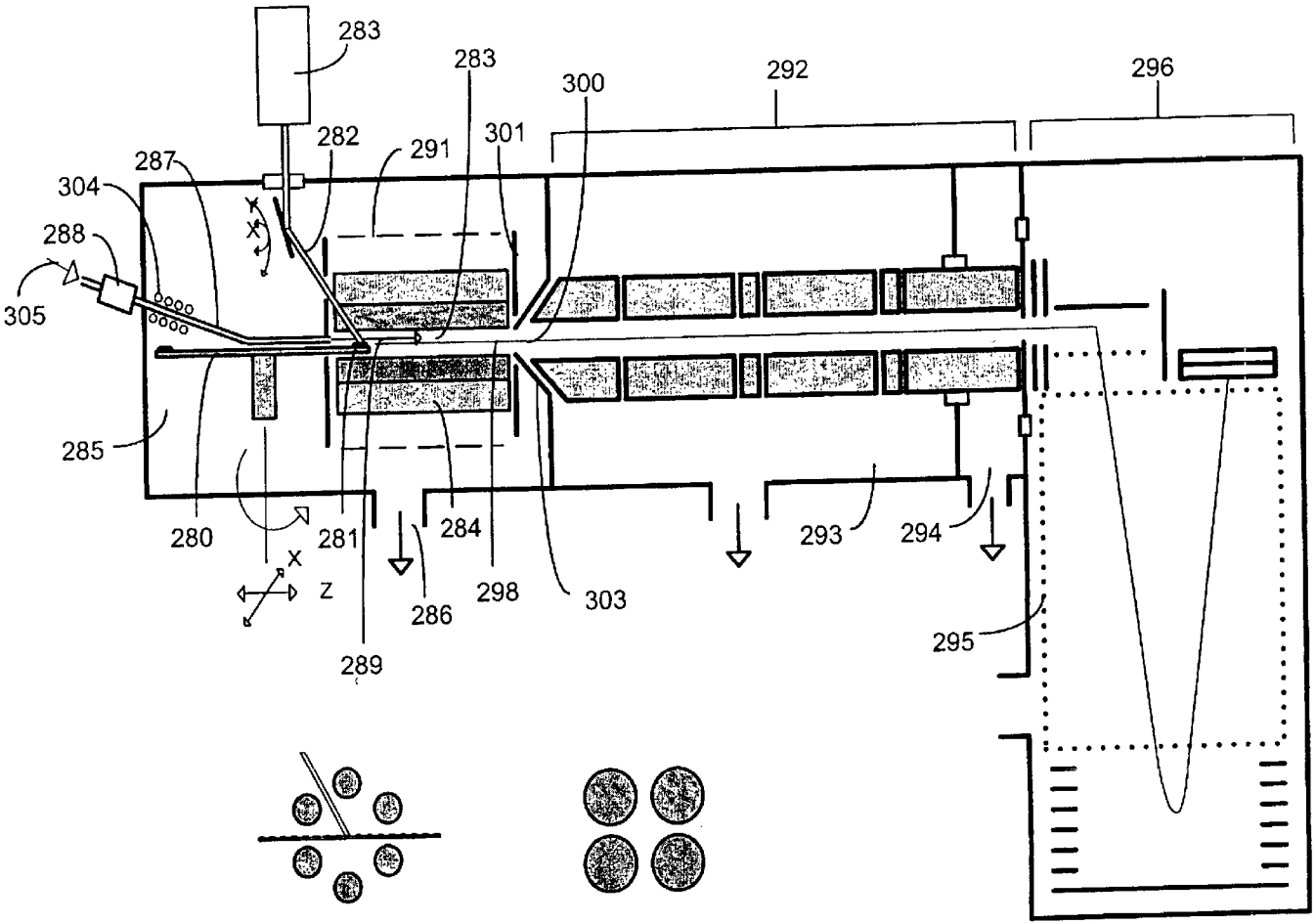
FIG. 15 shows a MALDI target configured so that the MALDI sample spot is positioned inside an multipole ion guide operated at low or intermediate vacuum pressures.
Figure 16:
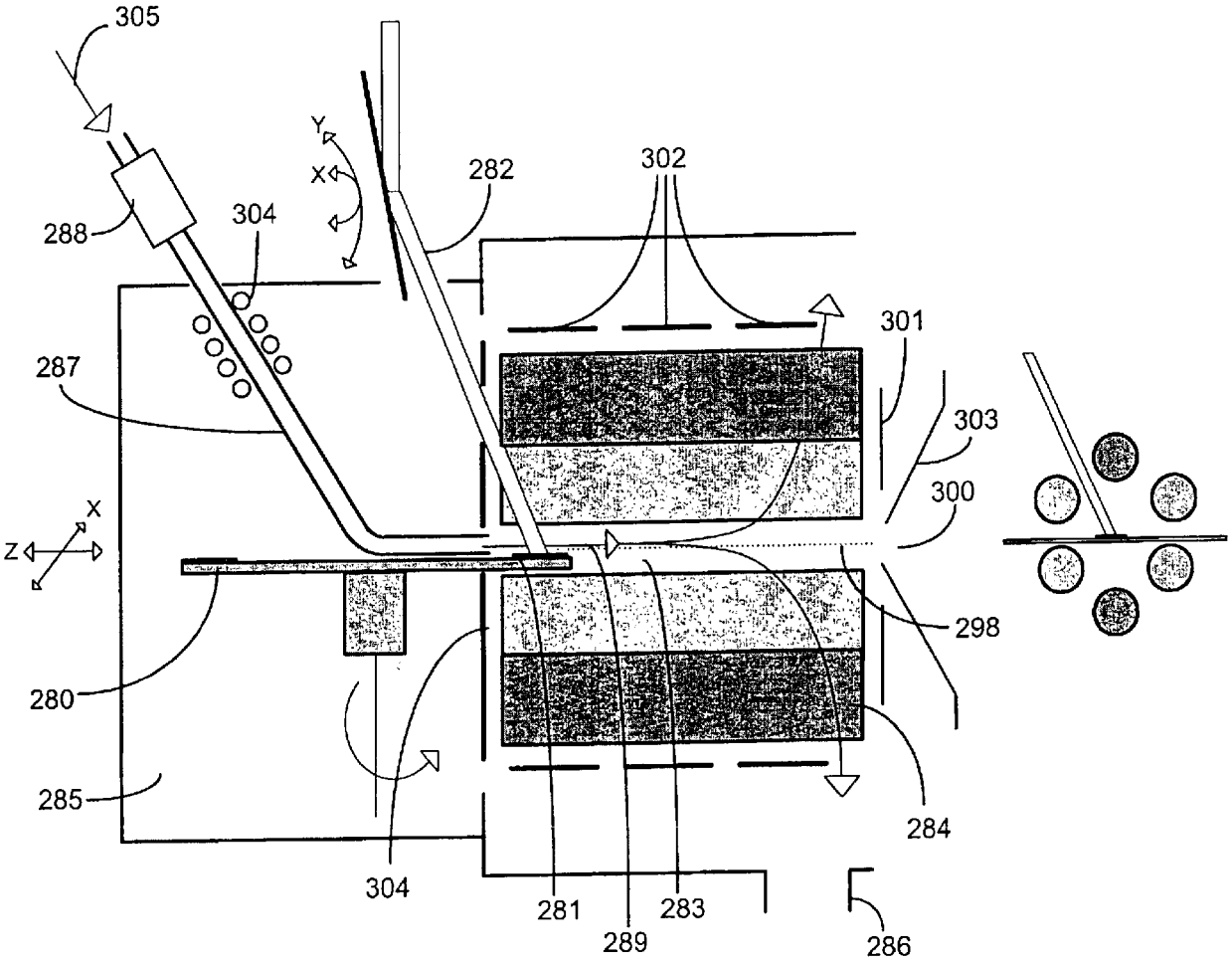
FIG. 16 shows an enlargement of the MALDI sample target, multipole ion guide and vacuum pumping stage region of the embodiment shown in FIG. 15.

An alternative embodiment of the invention configured for MALDI ionization in intermediate and low vacuum pressures is shown in FIGS. 15 and 16. Improvements in ion transport efficiency can be gained by operating a MALDI ion source configured according to the invention in vacuum when compared with atmospheric pressure MALDI ion source operation. Ions generated with MALDI ionization in vacuum are not required to pass through a small orifice leading into vacuum as is the case with ion generated with MALDI ionization at atmospheric pressure. It may not be possible to focus all MALDI generated ions through an orifice into vacuum that typically have diameters of less than 600 um resulting in ion losses with atmospheric pressure MALDI ion sources. Ion guide volumes, orifices or lenses between vacuum pumping stages are considerably larger and electrostatic fields have greater focusing effect in vacuum pressures improving overall ion transmission from intermediate or low vacuum pressure MALDI ion sources. A second advantage of an intermediate or low vacuum pressure MALDI ion source configured according to the invention is that the number of ion to neutral collisions experienced by MALDI generated ions can be controlled by adjusting the vacuum pressure in the MALDI ion source region. The number of collisions an ion experiences will affect its internal and translational energy. Controlling the number and location of ion to neutral collisions can be used to promote or suppress MALDI generated ion fragmentation and clustering and to damp translational energies and ion energy spread. These functional capabilities result in increased ion transport efficiency and signal sensitivity and increased analytical capability.

MALDI target 280 and multipole ion guide 284 are configured in vacuum chamber 285 that is evacuated through vacuum pumping port 286. MALDI ion source 291 located in vacuum chamber 285, is interfaced to a hybrid quadrupole ion guide TOF instrument whose function is similar to that described in FIG. 1. The pressure in vacuum stage 285 can be varied by adjusting gas flow 305 through gas channel 287 with gas flow valve 288. The background pressure in chamber 285 can be maintained sufficiently low to minimize or eliminate collisions between MALDI generated ions and neutral background gas molecules. Alternatively, the background pressure in chamber 285 can be maintained at a level where multiple collisions occur between MALDI generated ions and neutral background gas. Depending on the analysis being conducted either vacuum pressure range may have advantages. Ion collisions with background gas can reduce ion internal energy and reduce fragmentation. Multiple collisions with background gas can damp ion kinetic energies and increase ion capture and transport efficiency. Ion to neutral collisions can be used to study ion to neutral reactions when reactant gas is introduced into vacuum chamber 285. The flow rate of gas flow 305 can be adjusted by changing the gas flow rate setting of gas flow valve manually or automatically through programmed control to achieve optimal analytical performance.

In the embodiment shown in FIGS. 15 and 16, ions are generated by impinging laser pulse 282 from laser 283 on sample spot 281 mounted on movable MALDI target 280. Sample spot 281 is positioned inside multipole ion guide volume 283 where MALDI generated ions are directly subjected to the RF trapping fields in volume 283 of multipole ion guide 284 during ion guide operation. Gas flow 289 can be added through gas channel 287 with gas flow rate adjusted by valve 288. Gas flow 289 can be heated using heater 304 to reduce condensation of molecules released from sample spot 281 due to cooling as gas flow 289 expands into vacuum. The vacuum pumping speed through vacuum pumping port 286 is typically fixed, so the vacuum pressure in vacuum chamber 285 will increase by increasing the rate of gas flow 289. Increased gas pressure locally at sample spot 281 and in ion guide volume 283 causes collisional damping of ion kinetic and internal energies, minimizing ion fragmentation due to post source decay and maximizing ion capture and transport efficiency through multipole ion guide 284. MALDI generated ions whose mass to charge values fall within the operating stability region of multipole ion guide 284 are directed toward ion guide exit end 298 by gas flow 289, an axial DC field formed by different DC potentials applied to lens elements 302 as has been previously described and DC potentials applied to ion guide entrance lens 304, exit lens 301 and conical lens or skimmer 303. Ions exiting ion guide 284 are directed through orifice 300 of lens 303 and into multiple ion guide assembly 292. Ion mass to charge selection and fragmentation steps may be conducted in multipole ion guide assembly 292 prior to mass to charge analysis of ions in orthogonal pulsing Time-Of-Flight mass analyzer 296. Multipole ion guide 284, shown as a hexapole in FIGS. 15 and 16 can be alternatively comprise a quadrupole, an octapole or other odd or even numbers of poles. If ion guide 284 is configured as a quadrupole, ion mass to charge selection and fragmentation can be conducted in ion guide volume 283. By adjusting the electrical potentials applied to lenses 301 and 300, ions can be selectively trapped in or axially released from ion guide volume 283.

Figure 17:
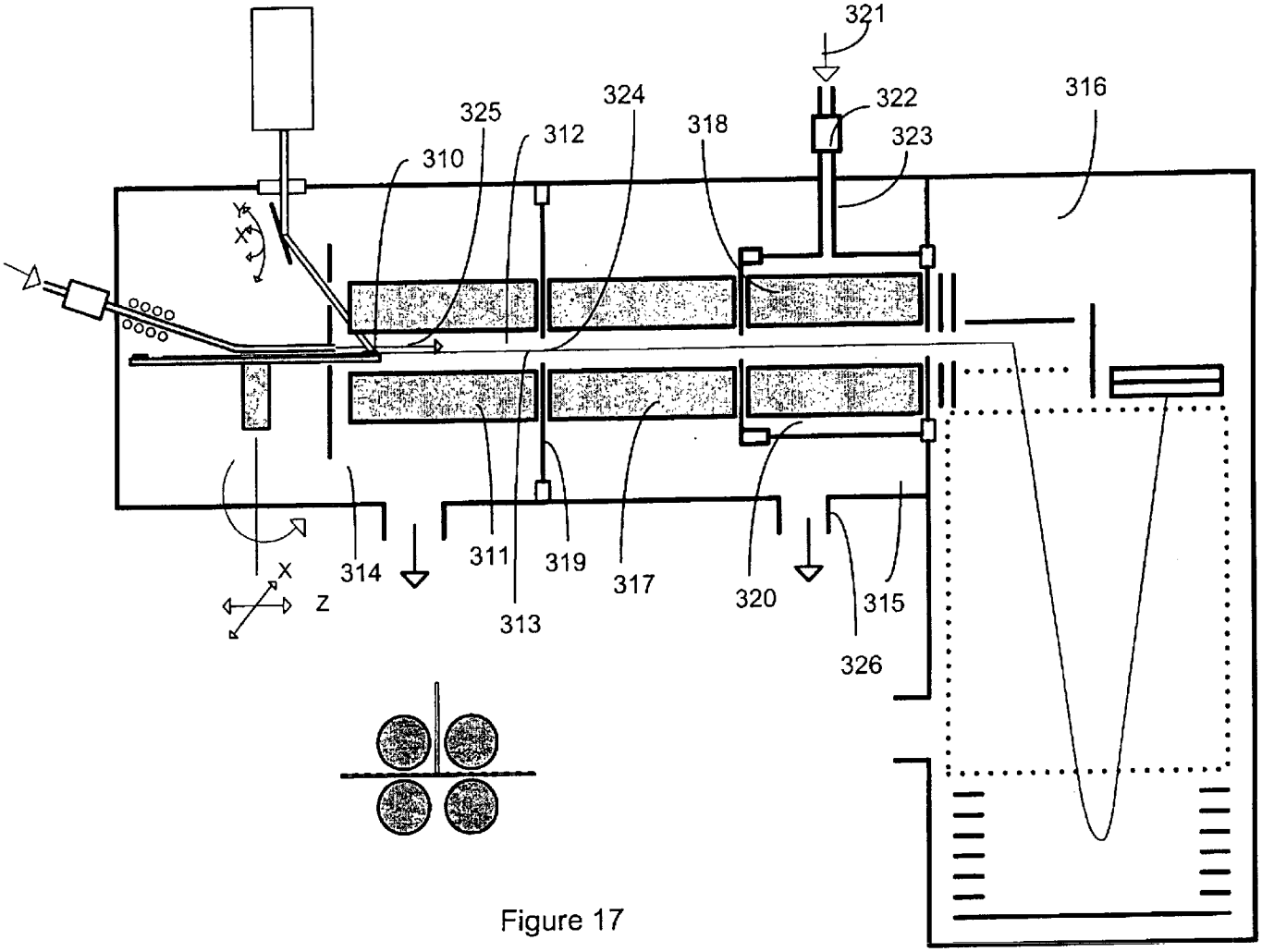
FIG. 17 shows a MALDI ion source operated in low or intermediate vacuum pressure configured with the sample spot positioned inside a multipole ion guide with a higher vacuum pressure multipole ion guide collision cell configured in a second vacuum pumping stage.
Figure 18:
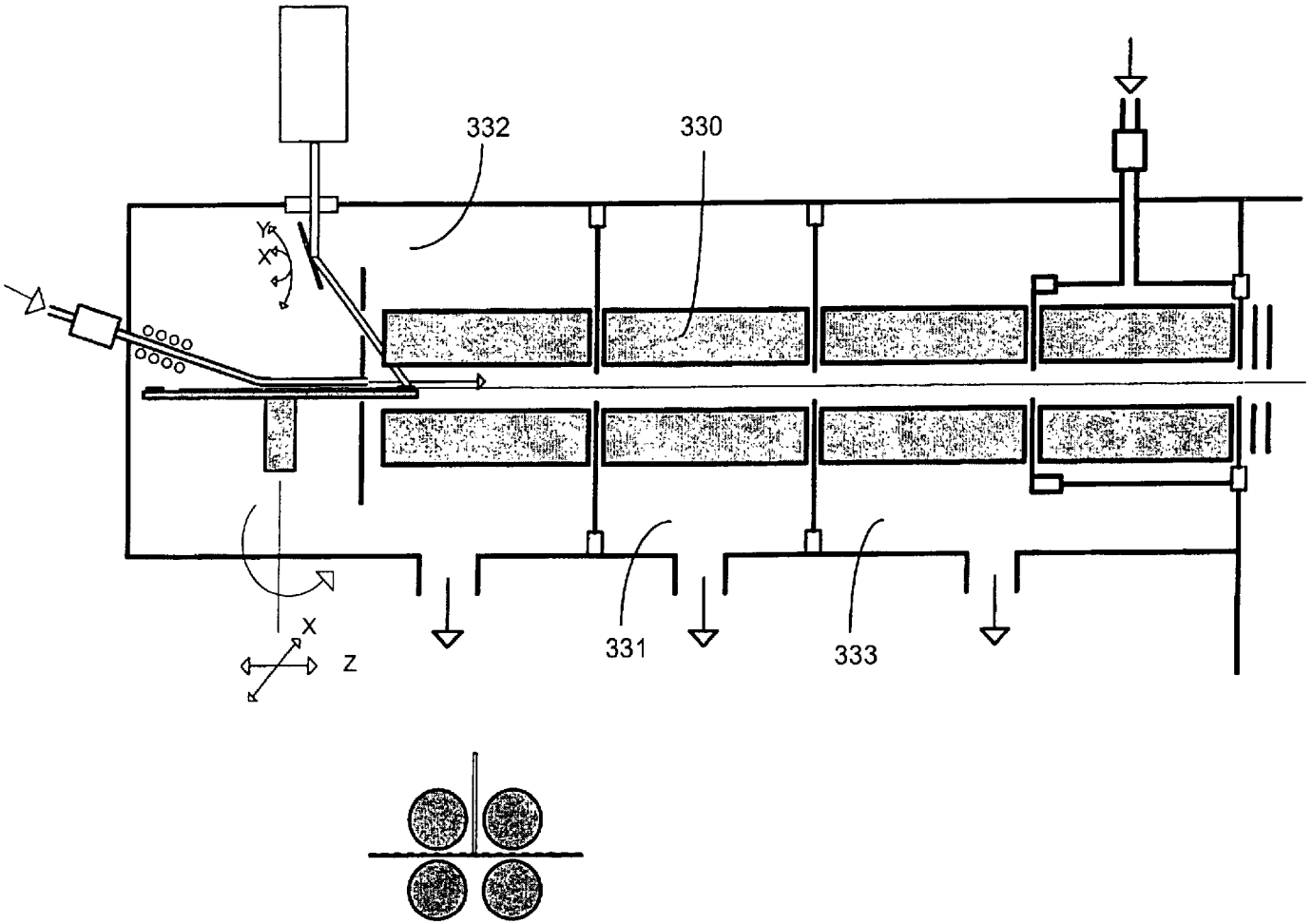
FIG. 18 shows a vacuum pressure MALDI ion source configured with the sample spot positioned inside a multipole ion guide with a higher pressure multipole ion guide collision cell configured a third vacuum pumping stage.
Figure 19:
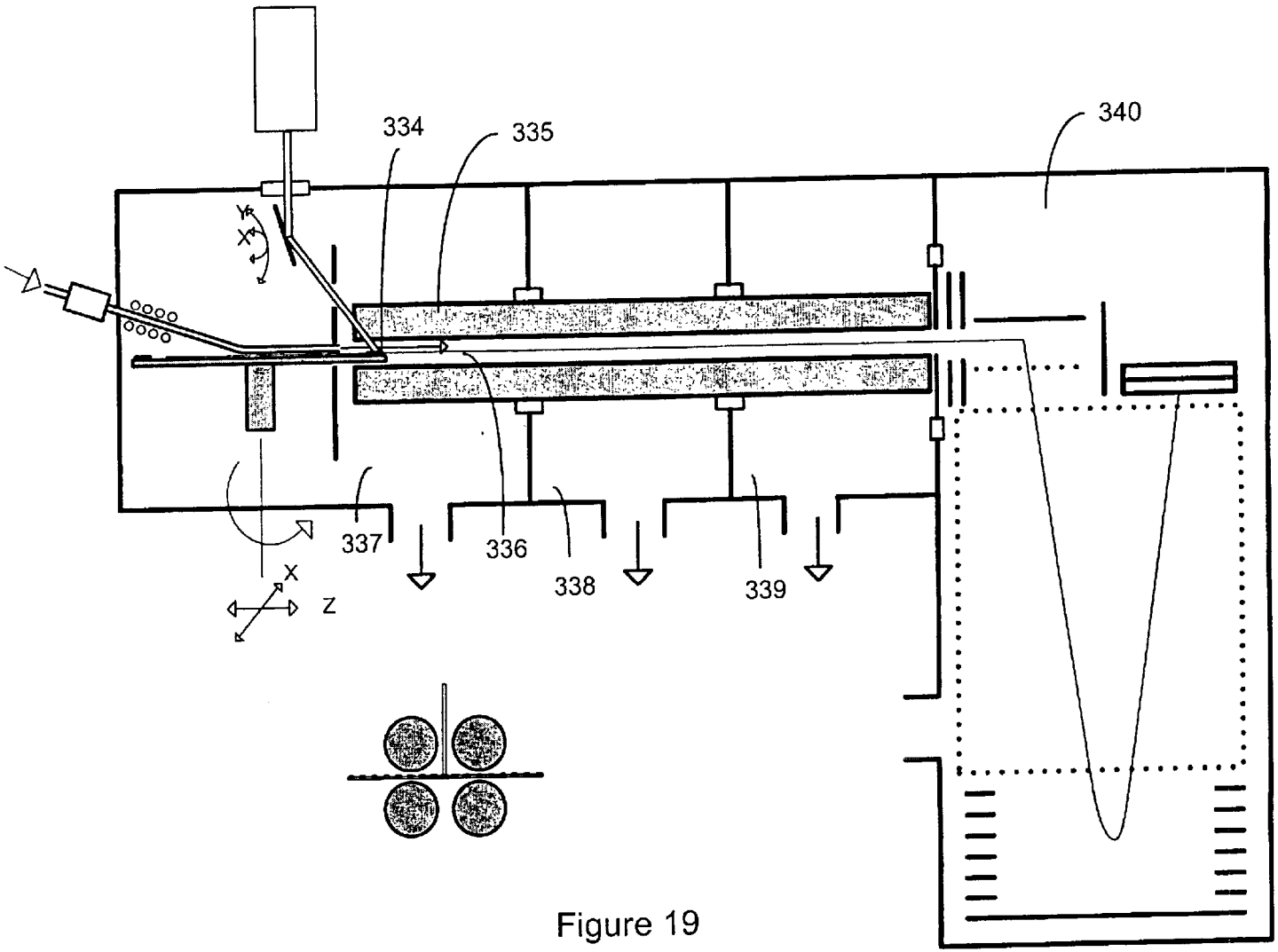
FIG. 19 shows a vacuum pressure MALDI ion source configured with the sample spot positioned inside a multipole ion guide that extends continuously through multiplevacuum pumping states.

In an alternative embodiment of the invention, downstream lenses and ion guides are reconfigured to allow an increased range of pressure in the vacuum MALDI ion source region and to increase the range of analytical capabilities in ion mass to charge analysis. FIGS. 17 through 19 show three alternative ion guide assembly embodiments interfaced to a vacuum MALDI ion source and a TOF ion mass to charge analyzer. A vacuum MALDI ion source embodiment according to the invention is shown in FIG. 17 where MALDI sample spot 310 is positioned in volume 312 of multipole ion guide 311. MALDI generated ions move through volume 312 of ion guide 311 toward ion guide exit end 313 as has been previously described. Electrostatic lens 319 forms a vacuum partition between vacuum chambers 314 and 315. Multipole ion guide 317, located in vacuum chamber 315, is positioned between lens 313 and collision chamber 320. Multipole ion guide 318 is configured in collision chamber 318. As is known in the art, additional vacuum pumping stages and/or ion guides can be added between collision chamber 320 and TOF mass analyzer 316 to reduce gas flow into TOF mass analyzer 316. MALDI generated ions traversing multipole ion guide 311 are directed through lens orifice 324 into ion guide 317. Ions can then pass through ion guide 317 and move into ion guide 318. Ions leaving collision chamber 320 are directed into TOF mass analyzer 316 where they are mass to charge analyzed. As was previously described in FIGS. 15 and 16, the vacuum pressure in vacuum chamber 314 can be adjusted by varying the rate of gas flow 325. The pressure in collision chamber 320 can be independently adjusted by controlling gas flow 321 through gas channel 323 with gas flow valve 322. The vacuum pressure in chamber 315 will be affected by the pressure in vacuum chamber 314 and collision chamber 320 but sufficient vacuum pumping speed can be applied through vacuum pumping port 326 in chamber 315 to minimize ion to neutral collisions over a wide range of operating pressures in chambers 315 and 320.

Multipole ion guide 311, configured as a quadrupole, can be used to trap and axially release ions and conduct ion mass to charge selection and ion fragmentation. The vacuum pressure in vacuum chamber 314 can be adjusted allowing a wide range of ion mass to charge selection and fragmentation functions to be conducted in multipole ion guide 311. For example conducting ion mass to charge selection using +/−DC and RF applied to the poles of quadrupole 311 as is know in the art achieves improved performance at vacuum pressures where collisional scattering affects are minimized. Multipole ion guides 317 and 318 individually in tandem can be used to mass select and fragment ions. Ions can be trapped in and axially released from ion guides 317 and 318. The MALDI ion source and multiple ion guide embodiment shown in FIG. 17 can be operated to achieve MS and MS/MS$^n$ functions with TOF ion mass to charge analysis. Additional vacuum pumping stages and multipole ion guides can be added to increase the operating pressure ranges of the vacuum MALDI ion source and increase analytical capability. One such embodiment is shown in FIG. 18 where multipole ion guide 330 has been added in vacuum pumping chamber 331. MALDI ion source 332 can be operated with increased pressure in this embodiment without compromising the vacuum pressure in vacuum stage 333. Multipole ion guide 330 can be used to conduct additional ion mass to charge selection and/or fragmentation steps if the vacuum pressure in chamber 331 is maintained at appropriate levels.

Multipole ion guides that extend through multiple vacuum pumping stages can be configured with a vacuum MALDI ion source according the invention to improve ion transmission efficiency and sensitivity. A single ion guide extending through multiple vacuum stages can be configured to reduce instrument size and cost compared with multiple ion guide configurations. FIG. 19 shows an alternative embodiment of the invention where MALDI sample spot 334 is positioned inside multipole ion guide volume 336. Ion guide 335 is configured to extend contiguously into multiple vacuum stages 337, 338 and 339. As is known in the art, multipole ion guides that extend into multiple vacuum stages can efficiently transport ions through large vacuum pressure gradients. Ion guides that extend into multiple vacuum pumping stages can be used to conduct ion mass to charge separation and fragmentation. As has been previously described, MALDI ions generated from sample spot 334 are radially trapped by the RF field present in ion guide volume 336 during operation. MALDI generated ions transverse the length of multipole ion guide 335 and are directed into TOF mass analyzer 340 where they are mass to charge analyzed.

Figure 20:
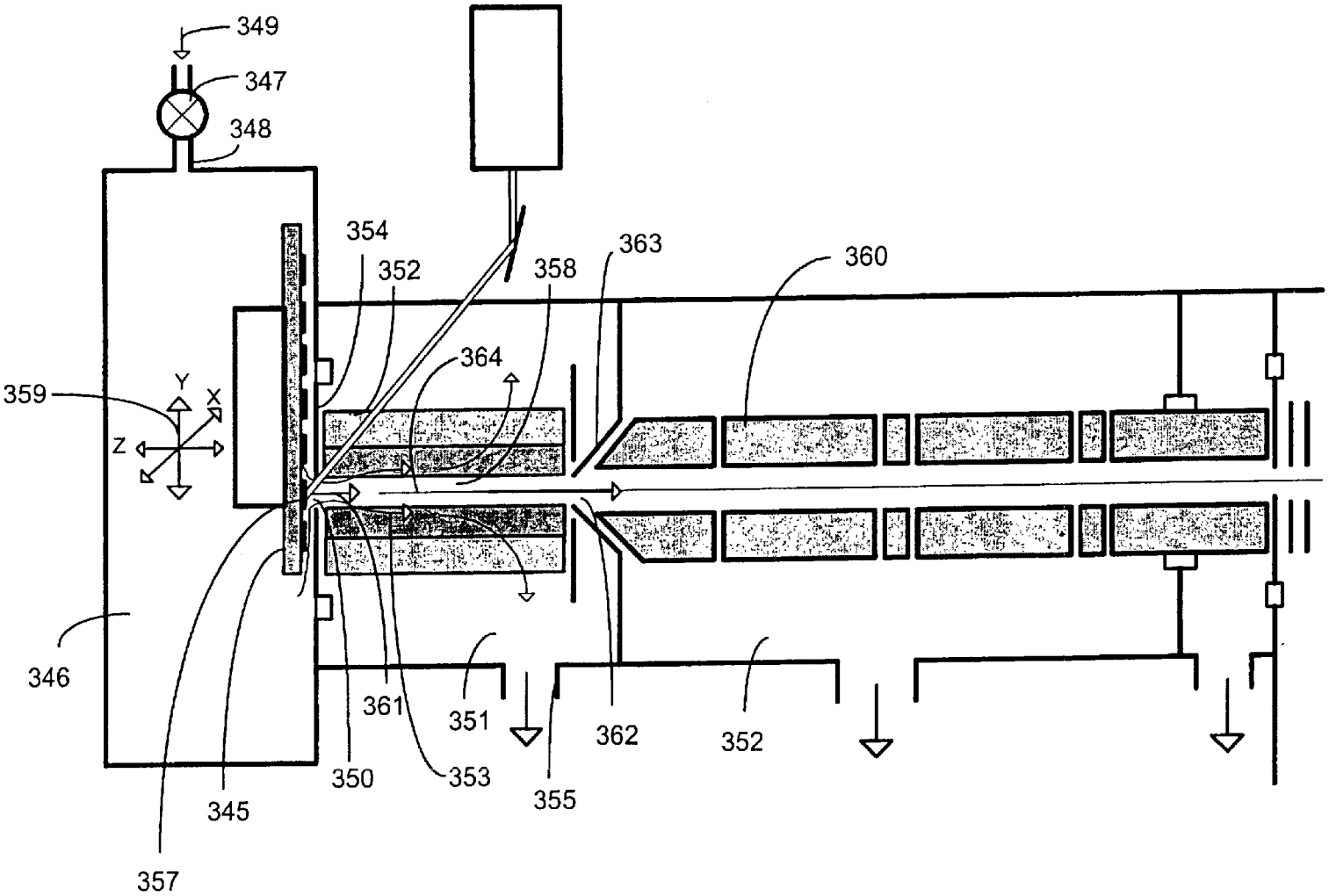
FIG. 20 shows a vacuum MALDI ion source where the MALDI target assembly is configured outside a multipole ion guide where gas flow s gas flow sweeps over the sample spot to help move MALDI produced ions into the multiple ion guide.

An alternative embodiment of a vacuum MALDI ion source configured according to the invention is shown in FIG. 20. Similar to the embodiment shown in FIGS. 11 and 12 for an atmospheric pressure MALDI ion source, MALDI target 345 is configured so that sample spots are positioned outside multipole ion guide volume 358. Gas flow 349 enters chamber 346 through flow control valve 347 and gas channel 348. Gas flow 353 exits chamber 346 through lens aperture 350 in electrostatic lens 354. The vacuum pressure in vacuum chamber 351 evacuated through vacuum pumping port 355 is set by the flow rate of gas flow 353 and the vacuum pumping speed through vacuum pumping port 355. Setting the flow rate of gas flow 349 through flow control valve 347 adjusts the vacuum pressure in vacuum chamber 351. Different vacuum pressures can be set in vacuum chamber 351 to achieve optimal performance for a given mass spectrometric analysis with MALDI ionization. The number of collisions a MALDI generated ion experiences near sample spot 357 can be adjusted to optimize ion internal energy and translational energy cooling. The gas flow 353 sweeping past sample spot 357 through lens aperture 350 helps to direct MALDI generated ions 361 into ion guide volume 358 where they are trapped radially by the RF fields during operation of multipole ion guide 352. MALDI generated ion transmission efficiency into ion guide 352 is aided by optimizing the gap between MALDI target 357 and electrostatic lens 354 by moving the MALDI target in the z direction with x-y-z translator 359. Electrostatic potentials applied to conductive MALDI target 357 and electrostatic lens 354 and the common DC offset potential applied to the poles of ion guide 352 can be optimized to improve the transfer efficiency of MALDI generated ions 361 into multipole ion guide 352 for any flow rate of gas flow 353. MALDI generated ions 361 traversing the length of multipole ion guide 352 and are directed through lens aperture 362 in electrostatic lens 363 and into multipole ion guide assembly 360 for MS or MS/MS$^n$ mass to charge analysis as previously described. MALDI generated ions 361 move through multipole ion guide 352 due to collisions with gas flow 353 and due to the presence of axial DC fields. Ion collisions with neutral background molecules in ion guide volume 358 aid in damping ion trajectories toward ion guide centerline 364 and reducing the kinetic energy spread of MALDI generated ions 361 whose mass to charge values fall within the stability region of ion guide 352 during operation. This improves ion transmission efficiency of MALDI generated ions into downstream vacuum chambers, ion guides and mass to charge analyzers.

Figure 21:
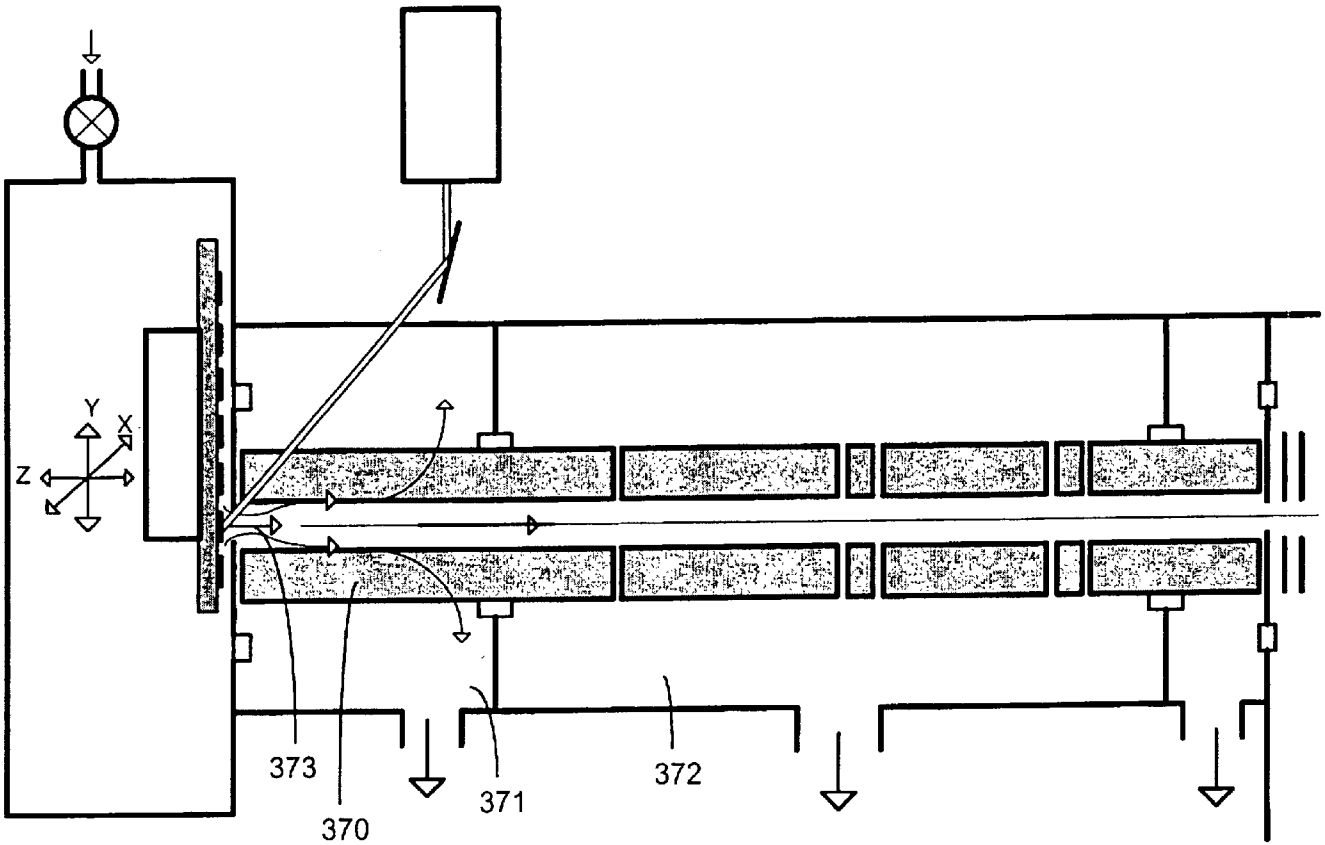
FIG. 21 shows a vacuum MALDI ion source with the MALDI target positioned outside a multipole ion guide that extends continuously into multiple vacuum pumping states.

Multipole ion guide 352 is replaced with multipole ion guide 370 in an alternative embodiment of the invention shown in FIG. 21. Multipole ion guide 370 extends from vacuum chamber 371 into vacuum chamber 372 providing efficient transfer of MALDI generated ions 373 through a wide range of vacuum pressure gradients. Multipole ion 370 may be operated in ion mass to charge selection mode. If the vacuum pressure is sufficiently high along a portion of the length of multipole ion guide 370, ion fragmentation may be conducted in multipole ion guide 370 using resonant frequency excitation collisional induced dissociation fragmentation.

Figure 22:
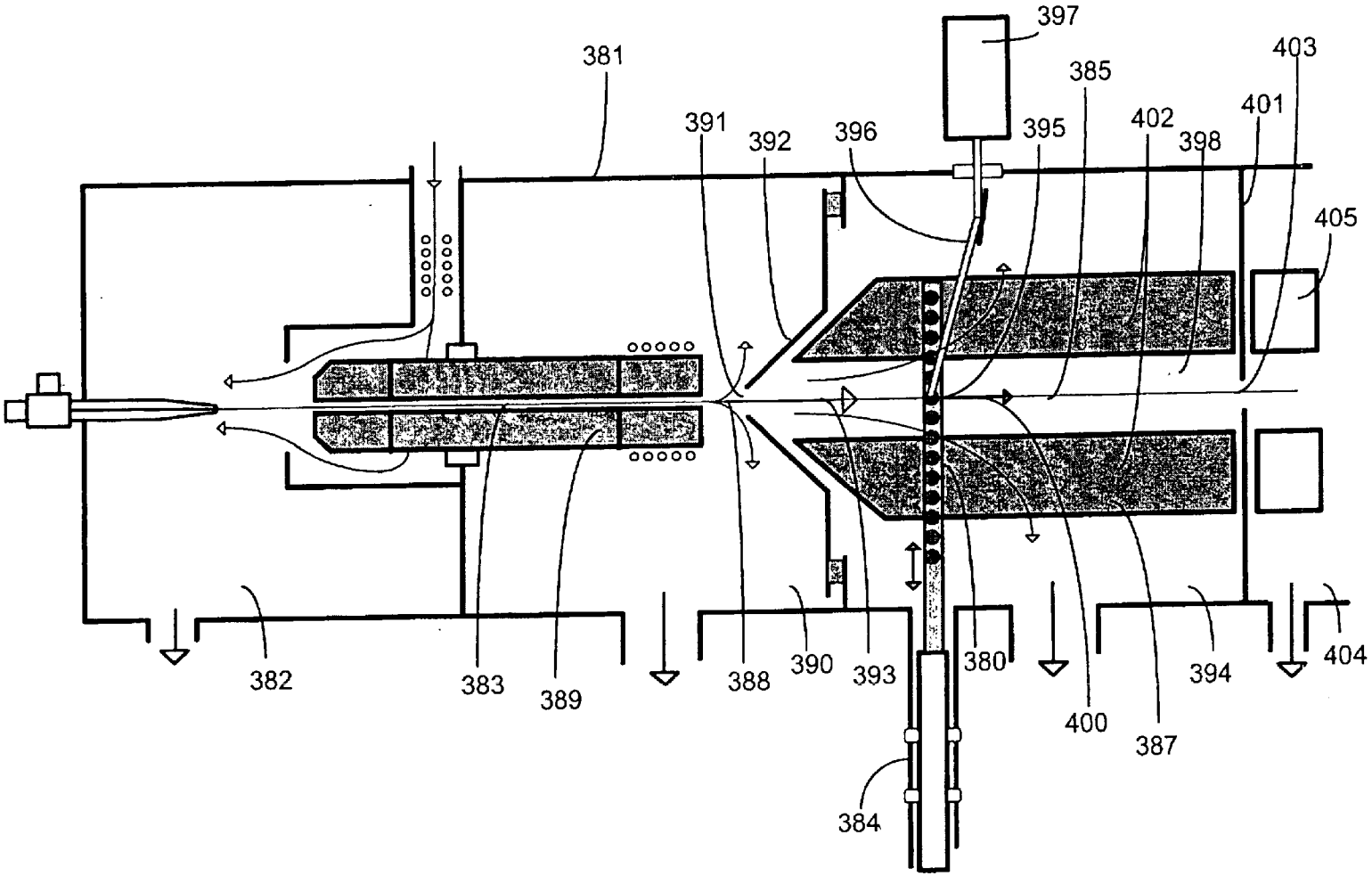
FIG. 22 shows a combination Electrospray ion source and vacuum MALDI ion source configured on the same mass analyzer with MALDI ions produced inside the volume of a multipole ion guide.

Combining Electrospray ionization and MALDI ionization in the same mass spectrometer instrument with the ability to switch rapidly and automatically to either ionization mode has advantages in cost, flexibility ionization modes and increased analytical capability. FIG. 22 shows an alternative embodiment of the invention in which MALDI target 380 is configured in mass spectrometer 381 requiring minimum change to the configuration of Electrospray ion source 382. The operation of Electrospray ion source 382 at atmospheric pressure is known in the art. Dielectric MALDI target 380 is inserted through vacuum lock 384 into ion guide volume 385 by passing through the gap between poles 402 of multipole ion guide 387. The Electrospray ion source may be turned off or operated during MALDI ionization and in either mode gas flow 388 continues to enter vacuum through bore 383 of capillary 389. Gas flow 388 forms a supersonic free jet expansion when it enters vacuum pumping stage 390 and a portion of gas flow 388 passes through orifice 391 of skimmer 392. Gas flow 393 flowing into vacuum pumping stage 394 through skimmer orifice 391 sweeps past MALDI target 380 and sample spot 395. Laser pulse 396 from laser 397 impinging on sample spot 395 produces ions that are radially trapped by the RF fields applied to multipole ion guide 387.

The movement of MALDI generated ions 400 toward exit end 398 of ion guide 387 is aided by gas flow 393 and an axial DC field applied along the length of ion guide 387. An axial DC field is formed by DC voltages applied to skimmer 392, ion guide exit lens 401 and the DC offset potential applied to rods 402 of ion guide 387. Additional electrostatic lens assemblies can be configured to created an axial DC field in ion guide 387 as has been previously described. Gas flow 393 provides sufficient pressure in vacuum stage 394 to cause collisional cooling of internal energies and translational energy damping of MALDI generated ions 400 in multipole ion guide 387. The MALDI generated ion population with reduced energy spread and reduced internal energy is directed from ion guide 387 through lens aperture 403 into ion guide 405 positioned in vacuum pumping stage 404 by applied the appropriate DC potentials to the poles of ion guide 387, electrostatic lens 401 and ion guide 405. MALDI generated ions 400 are subsequently mass to charge analyzed or subjected to mass selection and fragmentation steps prior to mass to charge analysis. Alternatively, MALDI generated ions 400 can be trapped in multipole ion guide 387 and selectively released into downstream ion guides and mass analyzers. MALDI target 380 can be removed through vacuum lock 384. Vacuum lock 384 can be configured, as is known in the art, to avoid venting vacuum when inserting or removing MALDI target 380. When MALDI target 380 is removed, the Electrospray ion source can be run in its normal operating mode. The insertion and removal of MALDI target 380 can be controlled manually or automated through computer control. Generating ions using Electrospray and/or MALDI ionization individually or simultaneously can be automated to maximize sample throughput and to provide optimal and complimentary analytical information.

Figure 23:
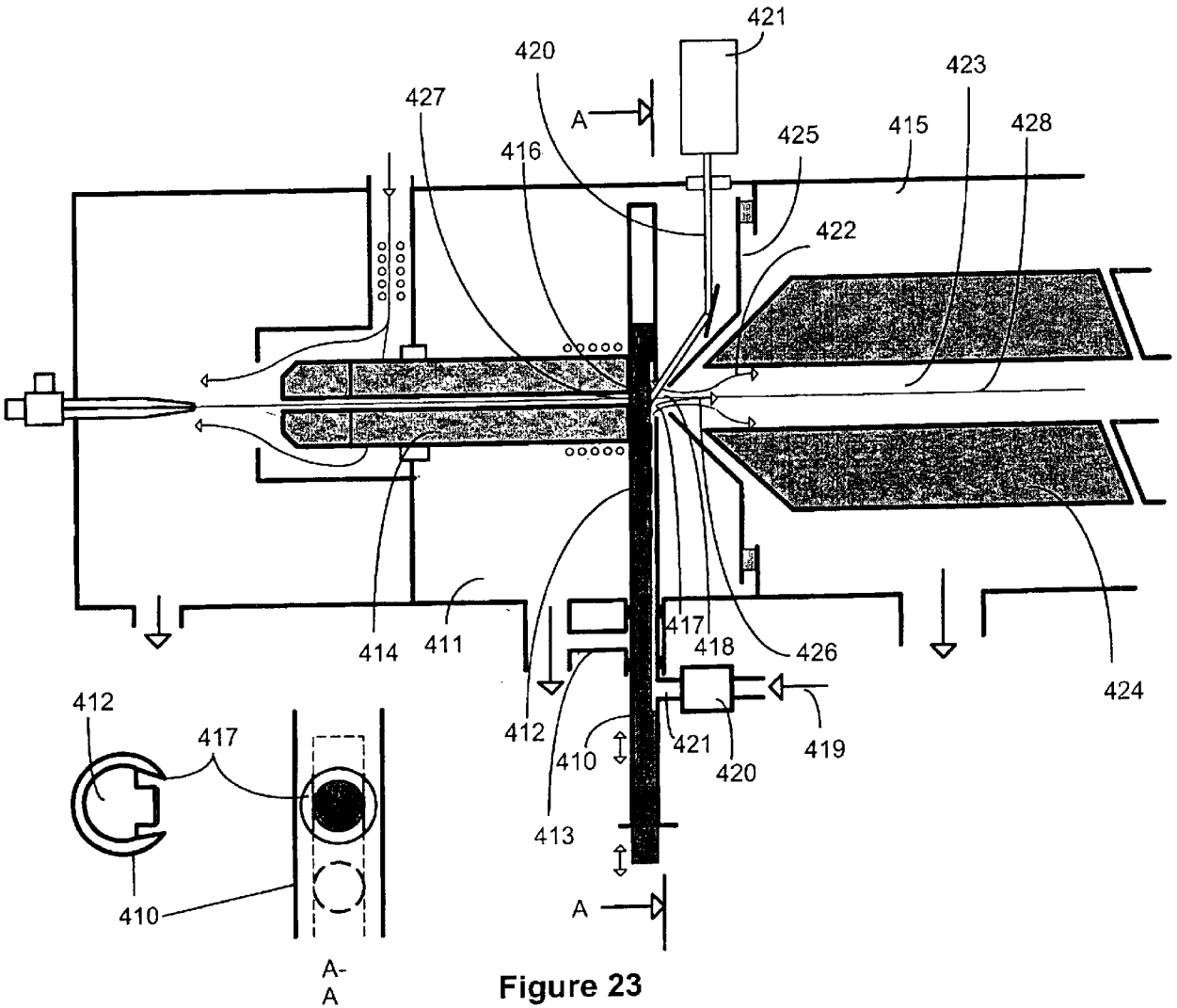
FIG. 23 shows a retractable MALDI probe assembly and target mounted in the gap between the capillary and skimmer of an Electrospray ion source with gas flow introduced through the probe assembly.

An alternative embodiment of a combined Electrospray and MALDI ion source is shown in FIG. 23. MALDI target probe assembly 410 comprising MALDI target 412 is inserted into first vacuum stage 411 through vacuum lock 413 without venting vacuum. Probe assembly 410 blocks capillary exit 427 when inserted into vacuum stage 411 stopping gas flow from atmospheric pressure through capillary 414. MALDI target 412 can move within probe assembly 410 aligning sample spot 416 with probe assembly orifice 417 and skimmer orifice 418. Gas flow 419 controlled by gas flow valve 420 enters probe assembly 410 through gas channel 421. Gas flow 422 sweeps over sample spot 416 and exits orifice 417 in probe assembly 410. A portion of gas flow 419 enters vacuum stage 411 and is pumped away. The remainder of gas flow 422 enters vacuum stage 415 through skimmer orifice 418. MALDI generated ions 422 are formed when laser pulse 420 from laser 421 impinges on sample spot 416. MALDI generated ions 426 are directed into ion guide volume 423 by gas flow 422 and the relative DC potentials applied to MALDI target 412, probe assembly 410, skimmer 425 and the poles of multipole ion guide 424. Gas flow 422 provides collisional damping of MALDI generated ion trajectories near sample spot 416 and in multipole ion guide volume 423 creating a population of ions 426 with a low energy spread and with trajectories that damp toward ion guide centerline 428 as the ions traverse the length of ion guide 424. MALDI generated ions 426 pass through multipole ion guide 424 and are subsequently mass to charge analyzed. Alternatively, MALDI generated ions 426 may be trapped and axially released from multipole ion guide 424. Ion mass to charge selection and/or fragmentation of MALDI generated ions 426 may be conducted in multipole ion guide 424 prior to ion mass to charge analysis. MALDI target 412 can be moved inside probe assembly 410 to align each sample spot with probe assembly orifice 417 for sample ionization. Sample probe 410 can be retracted through vacuum lock 413 without venting vacuum in vacuum stage 411. Electrospray ionization can be conducted when MALDI probe assembly 410 has been retracted from blocking the Electrospray ion beam. MALDI probe assembly 410 can be inserted and retraction manually or automated using programmed control.

Figure 24:
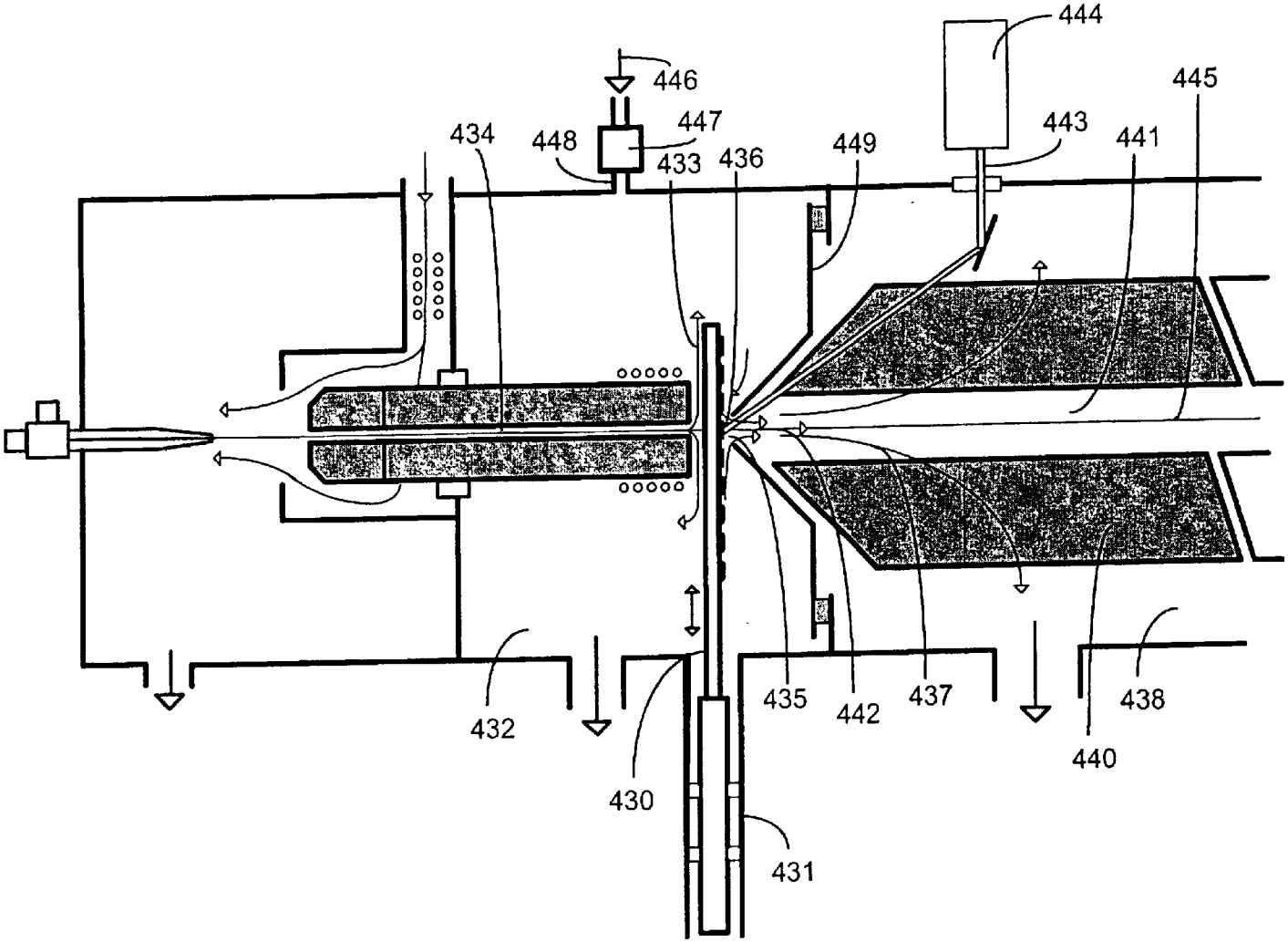
FIG. 24 shows a retractable MALDI target assembly mounted in the gap between the capillary and skimmer of an Electrospray ion source with gas flow introduced through the capillary or through and independent gas feedthrough.

MALDI target probe assembly 410 is simplified in the alternative embodiment of the invention shown in FIG. 24. MALDI target 430 is inserted into vacuum pumping stage 432 through vacuum lock 431 without venting vacuum in vacuum stage 432. Gas flow 433 from atmospheric pressure expanding through capillary bore 434 continues to flow with MALDI target 431 inserted. This MALDI target configuration retains the operating vacuum pressure in vacuum stage 432 similar to the vacuum pressure maintained during Electrospray operation. Neutral gas in vacuum stage 432 sweeps across sample spot 436 and through skimmer orifice 435 into vacuum stage 438. Similar to the embodiment shown in FIG. 23, MALDI generated ions 442 are directed into ion guide volume 441 by gas flow 437 and the DC potentials applied to MALDI target 430, skimmer 449 and the poles of multipole ion guide 440. Laser pulse 443 from laser 444 is directed through a gap between poles of multipole ion guide 440 and through skimmer orifice 435 to impinge on sample spot 436. MALDI generated ions 442 entering multipole ion guide volume 441 are radially trapped by the RF field applied to the poles of ion guide 440 and their trajectories are collisionally damped toward centerline 445 of ion guide 440 as they traverse the length of ion guide 440.

The gas flow rate into vacuum stage 432 can be controlled to provide different pressures and gas flow rates across sample spot 436. In an alternative embodiment of the invention, capillary bore 434 can be blocked at its entrance by a plug or valve or at its exit by the inserted MALDI probe assembly. With gas flow through capillary bore 434 blocked, gas flow 446 can enter vacuum stage 432 through gas flow control valve 447 and gas channel 448 by opening gas flow control valve 447. Gas flow control valve 447 can be adjusted to establish the desired pressure in vacuum stage 432 to optimize performance for a given MALDI mass analysis experiment. Ions can be generated from different sample spots by manually or automatically moving MALDI target 430 to align different sample spots with skimmer orifice 435. MALDI target 430 can be manually or automatically retracted and removed through vacuum lock 431 without venting vacuum in vacuum stage 432. Electrospray ionization can be continued when MALDI target 430 is retracted from centerline 445.

Figure 25:
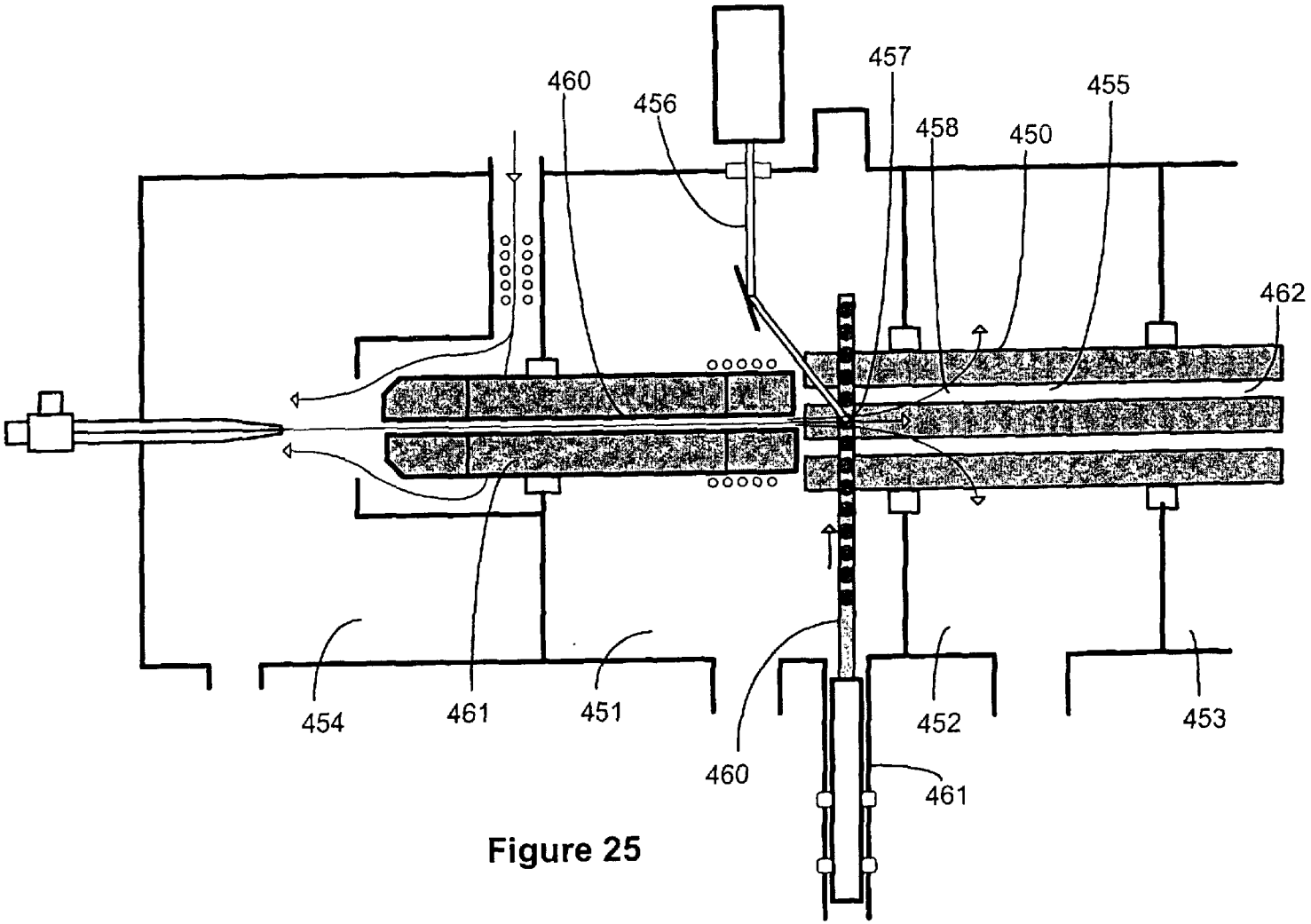
FIG. 25 shows a linear MALDI target configured to position sample spots inside a multipole ion guide which extends into multiple vacuum stages in a combination Electrospray and MALDI ion source.
Figure 26:
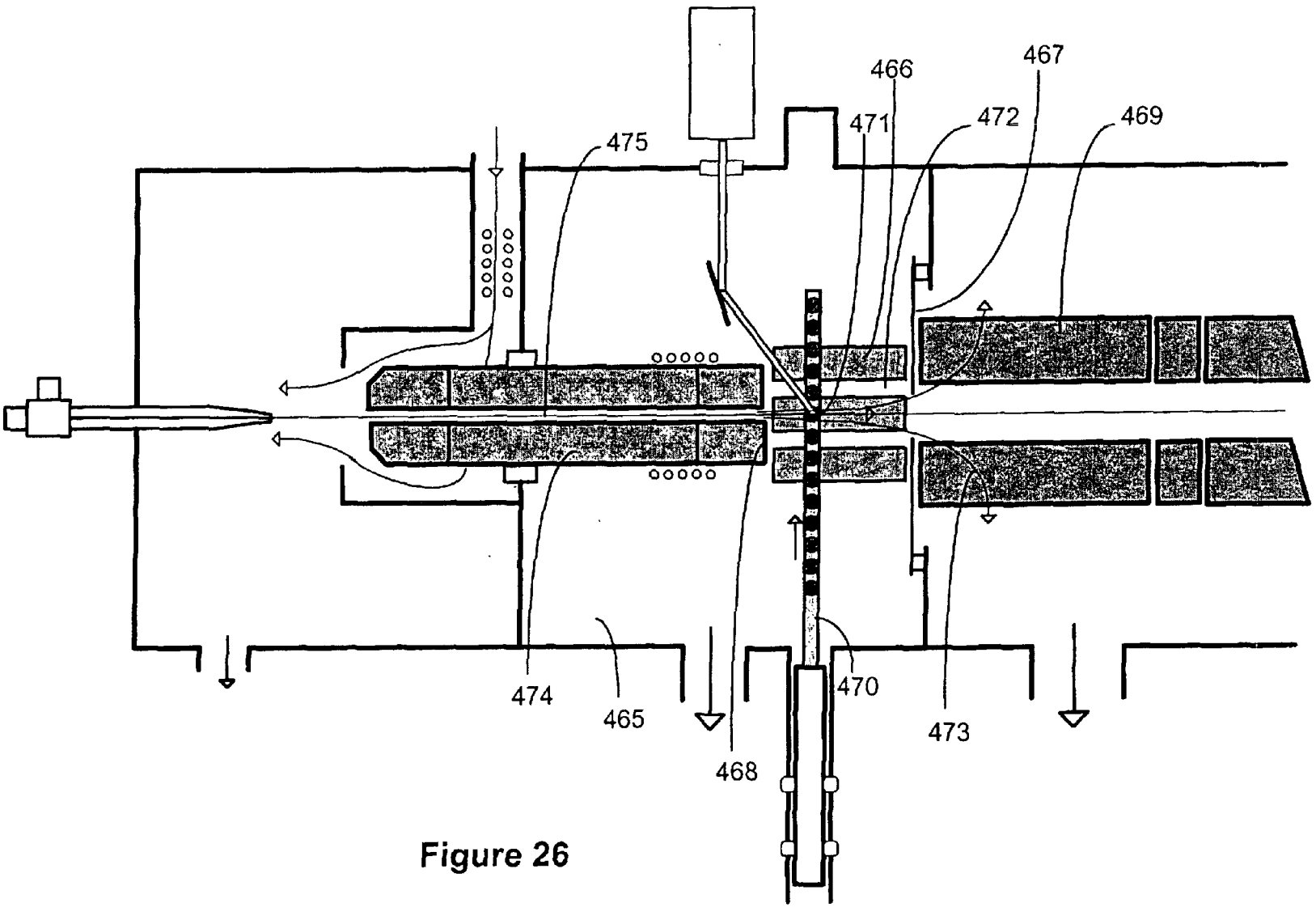
FIG. 26 shows a retractable MALDI target configured to position sample spots inside a multipole ion guide volume located in the first vacuum pumping stage of an Electrospray ion source.

Alternative embodiments of the invention are shown in FIGS. 25 and 26 wherein MALDI targets are inserted into ion guide volumes positioned in the first vacuum stage of an Electrospray ion source. In FIG. 25, multipole ion guide 450 extends into three vacuum stages 451, 452 and 453 of a mass to charge analyzer interfaced with Electrospray ion source 454. Multipole ion guide 450 provides high ion transfer efficiency to a mass analyzer through a wide range of vacuum pressures. Similar to the embodiment of the invention shown in FIG. 19, MALDI ions are generated in ion guide volume 455 by impinging laser pulse 456 on sample spot 457. Gas flow 458 exiting bore 460 of capillary 461 aids in sweeping MALDI generated ions away from sample spot 457 and toward exit end 462 of multipole ion guide 455. Dielectric MALDI target 460 can be manually or automatically moved or inserted and removed from vacuum lock 460 without venting vacuum in vacuum stage 451. When MALDI target 460 is removed, Electrospray ionization with mass to charge analysis can be conducted as a single ionization source. In an alternative embodiment of the invention shown in FIG. 26, vacuum stage 465 comprises a separate multipole ion guide positioned between capillary exit end 468 and electrostatic lens and vacuum partition 467. Different RF and DC potentials can be applied to the poles of multipole ion guides 466 and 469 to optimize performance during MALDI or Electrospray ionization. MALDI target 470 is inserted into ion guide volume 472 with sample spot 471 being swept by gas flow 473 through bore 475 of capillary 474 as has been described previously. Matrix assisted laser desorption ionization simultaneously generates positive and negative ions. Electrospray ionization can be conducted while simultaneously producing MALDI generated positive and negative ions to study ion to ion reactions in the embodiments shown in FIGS. 22, 25 and 26. Electrospray ions entrained in the gas exiting capillary bore 475 flow over MALDI sample spot 471 while MALDI ions are being produced allowing ion to ion reactions to occur. MALDI target probe 470 can be manually or automatically inserted, moved or retracted without venting vacuum in vacuum stage 465.

A MALDI ion source can be configured according to the invention to deliver positive and negative ions to two separate mass to charge analyzers as shown in FIGS. 27 and 28. Positive and negative ions may be produced when laser pulse 485 impinges on MALDI sample spot 480 in FIG. 27. An axial DC potential gradient is maintained along ion guide volume 487 by applying different DC potentials to ring electrodes 482 as previously described. Positive MALDI generated ions 486 created in ion guide volume 487 move toward ion guide exit end 488 and into MS 2 mass analyzer 484 for mass to charge analysis. Negative MALDI generated ions 490 created in ion guide volume 487 simultaneously move toward ion guide exit end 489 and into MS 1 mass analyzer 483 for mass to charge analysis. MALDI generated ions 486 and 490 are radially trapped in ion guide volume 487 as they traverse the length of ion guide 481 by the RF fields applied to the poles of multipole ion guide 481 during operation. The vacuum gas pressure in ion guide volume 487 can be maintained sufficiently high to provide multiple ion to neutral collisions between MALDI generated ions and background gas. Collisional damping of MALDI generated ions improves ion capture and transfer efficiency in multipole ion guide 481.

FIG. 28 shows one embodiment of the dual mass analyzer instrument diagrammed in FIG. 27. MS 1 comprises quadrupole TOF hybrid mass to charge analyser 500 and MS 2 comprises quadrupole TOF mass to charge analyzer 501. Positive 509 and negative 508 ions generated from sample spot 505 positioned in ion guide volume 504 are directed into multipole ion guides 507 and 506 respectively. Ion mass to charge selection and/or fragmentation can be conducted in ion guides 507 and 506 prior to directing ions into TOF mass analyzers 501 and 502 respectively for mass to charge analysis. Different parallel MS or $MS/MS^n$ analysis may be conducted with the different but simultaneously generated positive and negative MALDI ion populations. Mass spectra data acquired by conducting mass to charge analysis of both positive and negative MALDI generated ion populations can be combined and compared or evaluated independently.

In many embodiments of the invention described the multipole ion guides described can be substituted with other ion guide types including but limited to multiple ring electrode ion guides or ion funnels. Capillary orifices into vacuum as described in alternative embodiments of the invention can be substituted with other orifice types including but not limited to heated capillaries and aperture orifices. Additional or fewer vacuum pumping stages can be configured for the embodiments of the invention described. Alternative mass to charge analyzers can be configured with the invention including but not limited to quadrupoles, three dimensional in traps, TOF-TOF, magnetic sectors, Fourier Transform Mass Spectrometers, hybrid trap TOFs, orbitraps and two dimensional or linear ion traps.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

I claim:

1. An apparatus for analyzing chemical species comprising:

(a) a MALDI ion source with the MALDI sample spot positioned inside the volume of a multipole ion guide;

(b) a laser for producing MALDI generated ions whereby said ions are generated inside the volume of said multipole ion guide;

(c) means for directing said ions through the length of said multipole ion guide;

(d) a mass to charge analyzer;

(e) means for directing said ions to said mass to charge analyzer; and (d) a detector for detecting mass to charged analyzed ions.

2. An apparatus according to claim 1, wherein said MALDI ion source is operated at atmospheric pressure.

3. An apparatus according to claim 1, wherein said MALDI ion source is operated in vacuum.

4. An apparatus according to claim 1, wherein said MALDI generated ions experience multiple collisions with neutral molecules inside said volume of said multipole ion guide.

5. An apparatus according to claim 1, wherein said mass to charge analyzer is a Time-Of-Flight mass to charge analyzer.

6. An apparatus for analyzing chemical species comprising:

(a) a MALDI ion source with a MALDI sample spot positioned near the entrance of a multipole ion guide;

(b) a laser for producing MALDI generated ions whereby said ions are generated near said entrance of said multipole ion guide;

(c) a gas flow directed to move said ions generated from said sample spot into said multipole ion guide;

(d) means for directing said ions through the length of said multipole ion guide;

(e) a mass to charge analyzer;

(f) means for directing said ions to said mass to charge analyzer; and (g) a detector for detecting mass to charged analyzed ions.

7. An apparatus according to claim 6, wherein said MALDI ion source is operated at atmospheric pressure.

8. An apparatus according to claim 6, wherein said MALDI ion source is operated in vacuum.

9. An apparatus according to claim 6, wherein said MALDI generated ions experience multiple collisions with neutral molecules inside said volume of said multipole ion guide.

10. An apparatus according to claim 6, wherein said mass to charge analyzer is a Time-Of-Flight mass to charge analyzer.

11. An apparatus for analyzing chemical species comprising:

(a) a MALDI ion source with a MALDI sample spot positioned near the entrance of a multipole ion guide operated in a vacuum pressure region;

(b) a laser for producing MALDI generated ions whereby said ions are generated near said entrance of said multipole ion guide;

(c) a gas flow directed concentrically around said sample spot to move said ions into said multipole ion guide (d) means for directing said ions through the length of said multipole ion guide;

(e) a mass to charge analyzer;

(f) means for directing said ions to said mass to charge analyzer; and (g) a detector for detecting mass to charged analyzed ions.

12. An apparatus for analyzing chemical species comprising:

(a) a MALDI ion source with the MALDI sample spot positioned inside the volume of a multipole ion guide;

(b) An Electrospray ion source comprising said multipole ion guide;

(c) a laser for producing MALDI generated ions whereby said ions are generated inside the volume of said multipole ion guide;

(d) means for directing said ions through the length of said multipole ion guide;

(e) a mass to charge analyzer;

(f) means for directing said ions to said mass to charge analyzer; and (g) a detector for detecting mass to charged analyzed ions.

* * * * *